US007616180B2

(12) United States Patent
Martinot-Lagarde et al.

(10) Patent No.: US 7,616,180 B2
(45) Date of Patent: Nov. 10, 2009

(54) ADVANCED METHOD AND DEVICE WITH A BISTABLE NEMATIC LIQUID CRYSTAL DISPLAY

(75) Inventors: Philippe Martinot-Lagarde, Marcoussis (FR); Jacques Angele, Malakoff (FR); Stéphane Joly, Meudon la Foret (FR); Jean-Denis Laffitte, Leuville sur Orge (FR); François Leblanc, Paris (FR); Christophe Body, Gif sur Yvette (FR)

(73) Assignee: Nemoptic, Magny-les-Hameaux (FR)

( * ) Notice: Subject to any disclaimer, the term of this patent is extended or adjusted under 35 U.S.C. 154(b) by 669 days.

(21) Appl. No.: 10/557,721

(22) PCT Filed: May 14, 2004

(86) PCT No.: PCT/FR2004/001187

§ 371 (c)(1),
(2), (4) Date: Nov. 15, 2005

(87) PCT Pub. No.: WO2004/104980

PCT Pub. Date: Dec. 2, 2004

(65) Prior Publication Data

US 2007/0070001 A1 Mar. 29, 2007

(30) Foreign Application Priority Data

May 16, 2003 (FR) ..... 03 05934

(51) Int. Cl.
*G09G 3/36* (2006.01)

(52) U.S. Cl. ..... 345/87; 349/177; 349/188

(58) Field of Classification Search ..... 345/87; 349/188, 177

See application file for complete search history.

(56) References Cited

U.S. PATENT DOCUMENTS 6,151,096 A * 11/2000 McDonnell et al. ..... 349/188

(Continued)

FOREIGN PATENT DOCUMENTS

FR 2740894 5/1997

(Continued)

OTHER PUBLICATIONS

Joubert et al: "Ultra low poer bright reflective displays using BiNem technology fabricated by standard manufacturing equipment", SID Digest 2002, pp. 30-33, p. 30, fig. 1.

(Continued)

*Primary Examiner*—Amare Mengistu
*Assistant Examiner*—Premal Patel
(74) *Attorney, Agent, or Firm*—Blakely, Sokoloff, Taylor & Zafman LLP

(57) ABSTRACT

The invention relates to a bistable nematic liquid crystal matricial display device wherein the shift to one of the at least two bistable states is carried out by displacing the liquid crystal parallel to the surfaces of the device, characterized by the fact that it comprises a system for addressing various elements of the display device, characterized in that it comprises a system for addressing the various elements of the display device such that it does not simultaneously shift two adjacent elements located in the direction in which the material flows. The invention also relates to a display method. The invention makes it possible to control the grey level by controlling the scan rings of the hydrodynamic flow in order to define the border between two different textures.

40 Claims, 34 Drawing Sheets

"Orthogonal" 4-row x 4-column BiNem display according to the invention

U.S. PATENT DOCUMENTS 6,327,017 B2 * 12/2001 Barberi et al. ..... 349/177

FOREIGN PATENT DOCUMENTS

FR 2824400 11/2002

OTHER PUBLICATIONS

Giocondo et al: "Write and erase mechanism of Surface Controlled Bistable Ematic Pixel", European Physical Journal Applied Physics, vol. 5, No. 3, Mar. 1999, pp. 227-230.

* cited by examiner

PRIOR ART

PRIOR ART 4-row x 4-column BiNem display according to the prior art.

PRIOR ART

Control signals for simultaneous switching of the pixels.

Simultaneous switching of all the pixels to the U (white) state or T(black) state.

PRIOR ART

Figure 6 (continuation)
Frame 4: the pixels desired to be in the intermediate gray state are addressed
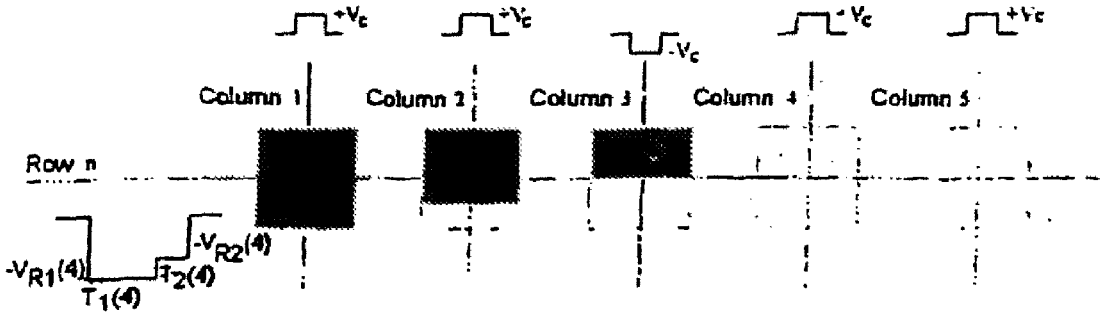
Frame 5: the pixels desired to be in the lightest gray state are addressed
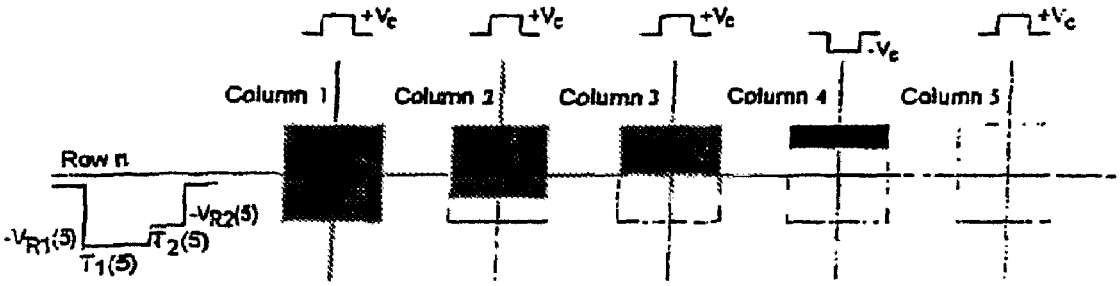
PRIOR ART Test set-up with multiplexing signals.

Pixel switching in a paraAB4 BiNem display in multiplexed mode.

PRIOR ART

Detail of the pixel edge defects on either side of a pixel in the brushing direction.

"Left-right" switching defect on pixels of the 160-row x 160-column display in reflective mode: the black state is the U state and the white state is the T states

PRIOR ART

Reference frame and velocity v of the liquid crystal.

Velocity v of the liquid crystal placed at various distances z from the slave plate as a function of the distance from the pixel edge.

"Orthogonal" 4-row x 4-column BiNem display according to the invention

Switching of the pixels in multiplexed mode with an orthogonal BiNem display.

Detail of the pixel edge defects. They appear along the two edges, perpendicular to the brushing direction, of all the pixels that switch to the T State.

45°-brushed 4-row x 4-column BiNem display.

Switching of the pixels in multiplexed mode with a 45°-brushed BiNem display.

Detail of the pixel edge defects for a 45°-brushed BiNem display.

Figure 19:
Geometric advantage of a "top-bottom" edge affect according to the invention.
19a: "left-right" edge effect
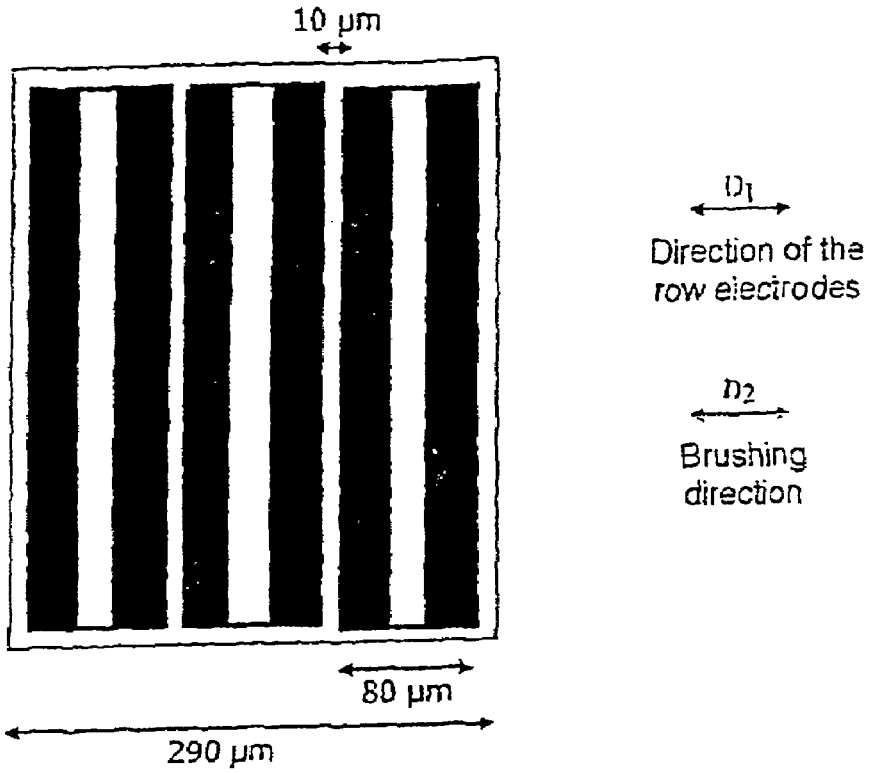
19b: "top-bottom" edge effect
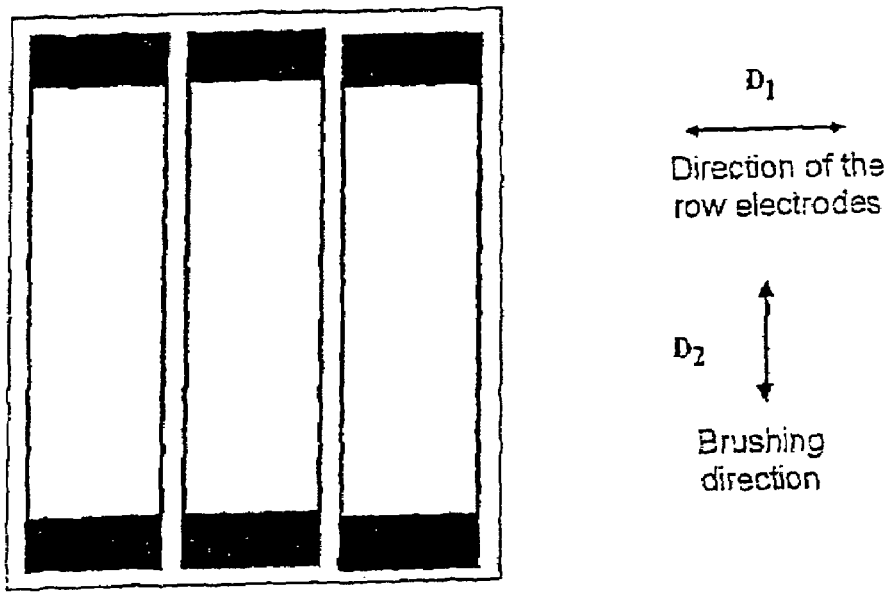

Electrooptic curve for a BiNem display with both the two possible, "left" and "right", multiplexing operating points.

Optical state of the pixels of a 160x480 display according ro the prior art ("parallel" brushing) as a function of the column voltage addressed by the signals defined in Table I: "on" (light) T texture; "off" (dark) U texture Optical state of the pixels of a 160x480 display according to the prior art ("parallel" brushing) as a function of the duration of the column voltage addressed by the signals defined in Table II: "on" (light) T texture; "off" (dark) U texture.

$D_l$
Direction of the row electrodes

Example of the modulation of the column signal parameters for producing grey levels by the "curtain effect" according to the invention:
a: modulation of the amplitude $V_C$
b: modulation of the duration $T_C$
c: modulation of the phase $\Delta T_C$ Principle of gray level production according to the invention.

Optical state of the pixels of a 160x480 display according to the invention as a function of the column voltage addressed by the signals defined in Table III: "on" (light) T texture; "off" (dark) U texture.

$D_1$

Direction of the row electrodes

Curve of the optical response as a function of the column voltage.

Optical state of the pixels of a 160x480 display according to the invention as a function of the duration of the column signal.

$D_1$

Direction of the row electrodes

Optical response curve as a function of the column signal voltage.

Optical state of the pixels of a 160x480 pixel BiNem display brushed at 60° to the direction of the row electrodes as a function of the column voltage.

$D_I$

Direction of the row electrodes

Example of row signals for a BiNem display addressed in two-step mode according to the invention. Example of a signal $V_{simul}$ of the one stage "T-setting" type and two-stage multiplexing signals.

Example of row signals for a BiNem display addressed in two-step mode according to the invention. Example of a signal $V_{simul}$ of the one stage "T-setting" type and two-stage multiplexing signals.

Example of row signals for a BiNem display addressed in two-step mode according to the invention. Example of a one-stage "T setting"-type signal $V_{simul}$ and one-stage multiplexing signals.

Example of row signals for a BiNem display addressed in two-stage mode according to the invention. Example of a ramped "U-setting"-type signal $V_{simul}$ and one stage multiplexing signals.

Example of row signals for a BiNem display addressed in two-stage mode according to the invention as described in Figure 33: 4x4 pixel BiNem display. The U texture is the "on" (light) state and the T texture is the "off" (dark) state.

Example of row signals for a BiNem display addressed in two-stage mode according to the invention as described in Figure 33. Optical response curve as a function of the voltage of the signal applied to the pixel.

Figure 36 :
Example of grey level formation by the "curtain effect" in multiframe mode.
The inoperative signal for the "on-hold, to be filled" pixels and the "already-filled" pixels is + $V_C$ on the column. Five-frame example: the white is given by T and the balck by U Objective: to write the following 5 pixels onto row m:

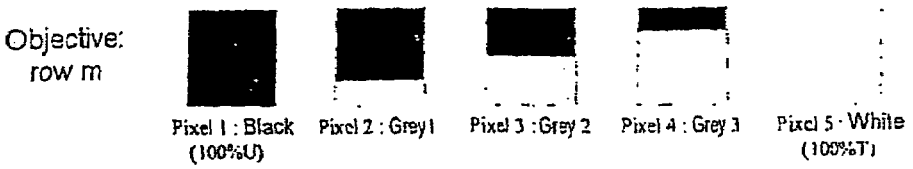

Frame 1: all the pixels in 100% T(White) [in simultaneous mode]

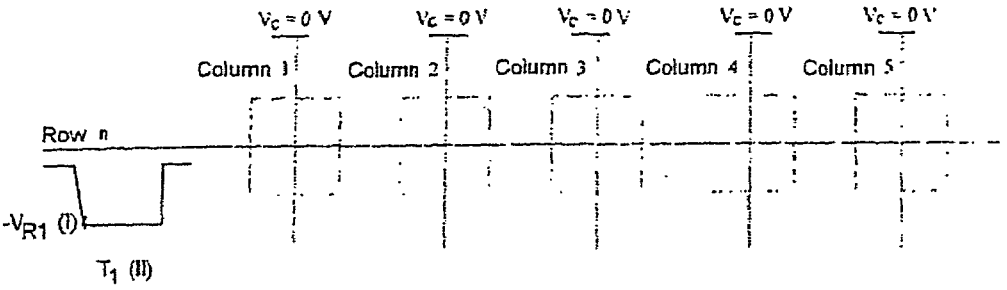

Frame 2: the pixels destined to be in the 100% U (black) state are addressed

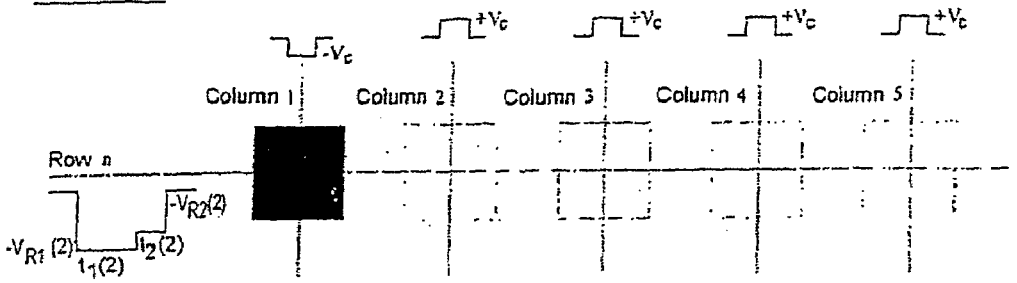

Frame 3: the pixels desired to be in the darkest grey state are addressed

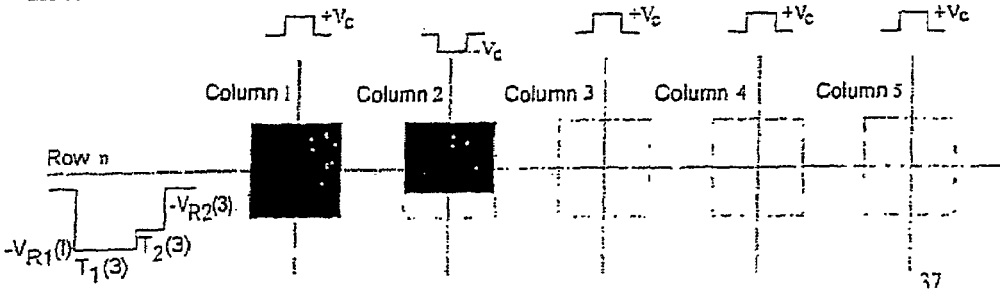

160X160 BiNem display addressed in multiframe mode
(8 frames in this example)

Figure 38 :
Magnification of a few pixels of the display shown in Figure 37
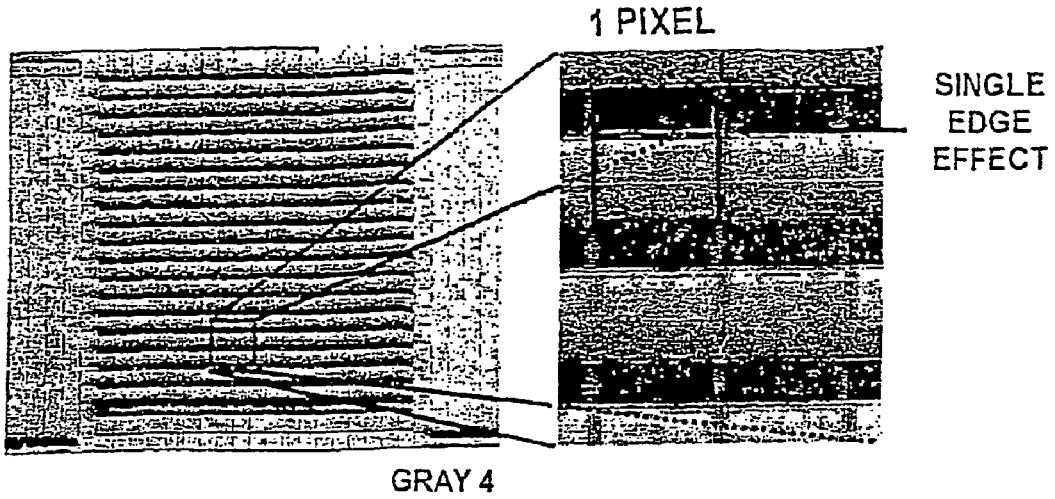
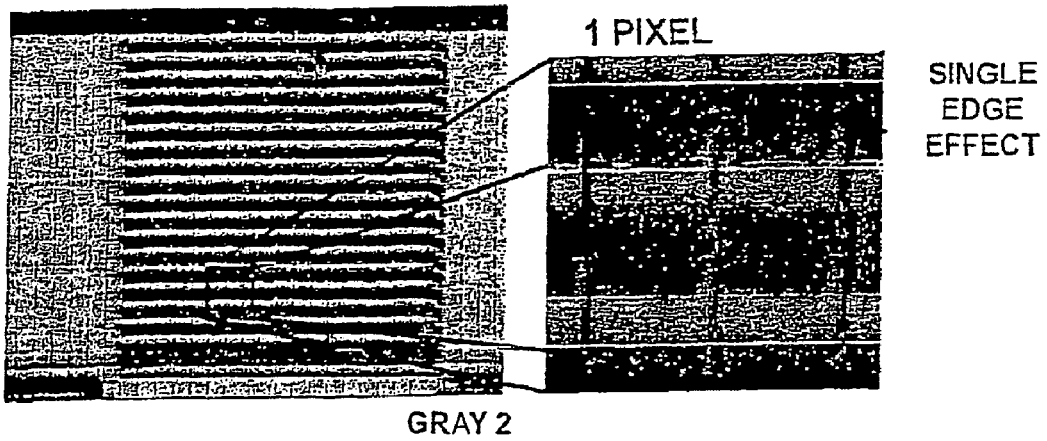

Optical response associated with each gray level of Figure 37

For a 90°-brushed BiNem display there are two possible scanning directions, namely one in the same direction as the hydrodynamic flow and the other in the direction opposite to the hydrodynamic flow.

Edge effects for producing gray levels or the "curtain effect" as a function of the display scanning direction.

ADVANCED METHOD AND DEVICE WITH A BISTABLE NEMATIC LIQUID CRYSTAL DISPLAY

FIELD OF THE INVENTION

The present invention relates to the field of liquid-crystal displays.

More precisely, the present invention relates to bistable nematic liquid-crystal displays. The present invention applies in particular to bistable nematic liquid-crystal displays with anchoring breaking, two stable textures of which differ by an approximately 180° twist.

OBJECT OF THE INVENTION

The first object of the present invention is to improve the performance of bistable display devices.

The second object is to propose a novel bistable display device for obtaining gray levels.

These two results are obtained by the use of novel means which allow gray levels to be displayed and which, when display with gray levels is not required, also improve display quality in black and white.

In particular, these novel means can significantly improve the optical definition of the pixels when addressing a multiplexed bistable display, by reducing the edge effects affecting the switching. They also allow non-uniformity defects that affect the images presented by these displays to be significantly reduced. In addition, these novel means allow controlled gray levels to be obtained that are uniform over the entire display.

PRIOR ART

Several bistable nematic liquid-crystal devices have already been proposed.

One of them, to which the present invention applies most particularly, is known by the name "BiNem".

Bistable nematic liquid-crystal displays Bistable nematic with anchoring breaking, two stable textures of which differ by a 180° twist, called "BiNem" displays, are described in Documents [1] and [2].

According to this process, a BiNem display consists of a chiralized nematic liquid-crystal layer placed between two substrates formed from two glass plates, one called the "master" plate MP and the other the "slave" plate SP. Row and column electrodes EL, placed respectively on each of the substrates, receive electrical control signals and allow an electric field perpendicular to their surfaces to be applied to the nematic liquid crystal. Anchoring layers $AL_S$ and $AL_W$ are deposited on the electrodes. On the master plate, the anchoring $AL_S$ of the liquid-crystal molecules is strong and slightly inclined, while on the slave plate this anchoring $AL_W$ is weak and flat or very slightly inclined.

Two bistable textures can be obtained. They differ from each other by a ±180° twist and are topologically incompatible. One is called the U texture, which is a uniform or slightly twisted texture, and the other is called the T texture, which is a twisted texture. The spontaneous pitch of the nematic is chosen to be approximately equal to one quarter of the thickness of cell, in order to make the energies of the U and T states essentially equal. When there is no field, no other state with a lower energy exists: the U and T states exhibit true bistability.

In a high electric field, an almost homeotropic texture, called H, is obtained. The molecules on the slave surface are normal to the plate near its surface and the anchoring is said to be "broken". When the electric field is cut off, the cell changes towards one or other of the bistable states U and T (see FIG. 1). When the control signals used induce a strong flow of the liquid crystal near the master plate, the hydrodynamic coupling between the master plate and the slave plate induces the T texture. If this is not the case, the U texture is obtained by elastic coupling, aided by the possible tilt of the weak anchoring. In the rest of the description, it will be understood that the "switching" of a BiNem screen element takes place by the liquid-crystal molecules passing through the homeotropic state. (anchoring breaking) and then changing to one of the two bistable states U or T, when the electric field is cut off.

The hydrodynamic coupling [6] between the slave plate SP and the master plate MP is dependent on the viscosity of the liquid crystal. When the field is turned off, the return to equilibrium of the molecules anchored on the master plate MP creates a flow close to said plate. The viscosity causes this flow to diffuse over the entire thickness of the cell in less than one microsecond. If the flow is quite strong; close to the slave plate SP, the molecules there at are tilted in the direction that induces the T texture; they turn in opposite directions on the two plates. The return to equilibrium of the molecules close to the slave plate SP is a second motor for the flow—it enhances and aids homogeneous passage of the pixel into the T texture. Thus, the transition from the H texture in a field to the T texture is obtained thanks to a flow and therefore a displacement of the liquid crystal in the direction in which the anchoring of the molecules on the master plate MP is tilted (see FIG. 2).

The elastic coupling between the two plates gives the molecules close to the slave plate SP, in the H texture in a field, a very slight tilt, even though the field applied tends to orient them perpendicular to the plates. This is because the tilted strong anchoring on the master plate MP keeps the adjacent molecules tilted. The tilting close to the master plate MP is transmitted by the orientation elasticity of the liquid crystal to the slave plate SP; on said plate the strength of the anchoring, and any tilting of the latter, increases the tilting of the molecules [7]. When, on turning off the field, the hydrodynamic coupling is insufficient to overcome the residual tilt of the molecules close to the slave plate SP, the molecules close to both plates return to equilibrium, by rotating in the same direction: the U texture is obtained. These two rotations are simultaneous—they induce counteracting flows in opposite directions. The total flow is zero. There is therefore no overall displacement of the liquid crystal during the transition from the H texture to the U texture.

BiNem displays are usually matrix screens formed from n×m pixels, produced at the intersection of the perpendicular conducting bands deposited on the master and slave substrates. Application of multiplexing signals makes it possible, by the combination of row and column signals, to select the file state of the n×m pixels of the matrix: the voltage applied to the pixel during the row select time forms a pulse which, firstly, breaks the anchoring and then, in a second phase, determines the final texture of the pixel. Typically, as required, during this second phase, the voltage applied is either suddenly removed, causing a voltage drop sufficient to induce the twisted T texture, or falls steadily, possibly in steps, and creates the uniform texture U. The excursion of the pixel voltage determining the rate of voltage drop is generally small. It is produced by what are called "column" multiplexing signals and contains the image information. The pixel voltage excursion for breaking the anchoring is higher. It is produced by what are called "row" multiplexing signals and is independent of the content of the image. Hereafter, the electrodes of the display for applying the "row" signals are called row electrodes and the electrodes for applying "column" voltages are called column electrodes. By applying the multiplexing signals it is possible to select the texture of all the pixels of a row by scanning each row of the screen in succession and by simultaneously applying the column signals that determine the state of each pixel of the row selected.

Optically, the two states, U and T are very different and allow black-and-white images to be displayed with a contrast of greater than 100.

Limitations of BiNem Displays Produced According to the Prior Art

Under certain circumstances, switching defects are experimentally observed in black-and-white BiNem bistable displays produced according to the art prior to the present invention.

High-magnification observation of the pixels sometimes shows the presence of parasitic textures close to the edges of the pixels. This edge effect can significantly degrade the switching of the pixels, the definition of the images and their contrast.

Moreover, it is difficult to obtain excellent image uniformity when the display is multiplexed. The dispersion of threshold voltages on the surface of the display sometimes exceeds the regulating latitude permitted by the multiplexing signals.

Experimental Study on Addressed-Pixel Switching Defects

The present invention results from the following experiments that culminate from extensive studies based on the first observations of the aforementioned defects.

Several BiNem displays similar to those proposed by the publication [1] were produced so as to identify the causes of the edge effects and to seek a solution thereto. Two types of test vehicle were produced, one possessing 4×4 pixels and the other 160×160 pixels.

Description of the 4-row×4-column BiNem Display Produced According to the Prior Art The first BiNem displays produced for studying edge effects consisted of a chiralized nematic liquid-crystal layer placed between two substrates formed from glass plates. Row electrodes L1, L2, L3 and L4 and column electrodes R1, R2, R3 and R4, placed respectively on each of the substrates, received electrical control signals and allowed an electric field perpendicular to the surfaces to be applied to the nematic liquid crystal. Anchoring layers were deposited on the electrodes. The anchoring of the liquid-crystal molecules on the master plate was strong and slightly tilted, whereas on the slave plate it was weak and flat.

Conventionally, these anchoring layers were brushed in order to determine the orientation and the anchoring of the liquid crystal molecules.

This BiNem bistable display had four column electrodes and four row electrodes, placed respectively on the master substrate MP (strong anchoring) and the slave substrate SP (weak anchoring) and defining in total 16 pixels. The width of the electrodes was about 2 mm, their length about 10 mm and the insulation between two electrodes was about 0.05 mm.

The display was placed between two linear polarizers, the whole assembly being observed in transmission by means of a backlighting device. The axes of the polarizers were approximately crossed and oriented at about 45° to the common alignment direction of the anchoring layers. In this configuration, the optical transmission of the U (uniform or slightly twisted) texture was high—it was in state (and appeared light). The optical transmission of the T (twisted) texture was low—it was off state (and appeared dark). This BiNem display is termed AB4.

The BiNem display according to the prior art possessed the brushing direction parallel to the row electrodes (the brushing directions of the master plate MP were parallel to that of the slave plate SP, but in the opposite sense).

An AB4 BiNem display with "parallel" brushing, as illustrated in FIG. 3, was produced for initial characterization of the edge defects. We termed this display paraAB4.

Switching of a 4×4 BiNem Display Produced According to the Prior Art

Pixel Switching by Simultaneous Addressing (Non-multiplexed Mode)

The paraAB4 row and column electrodes were connected to a drive electronics. In a first experiment, the four rows (denoted L1, L2, L3 and L4) of the display were connected together to the same potential $V_R$ and the four columns (denoted by R1, R2, R3 and R4) were connected to the same potential, denoted $V_C$. A potential difference was then applied between $V_R$ and $V_C$.

The applied signal was a control signal with two voltage levels, as illustrated in FIG. 4, namely a voltage level $V_1$ above the anchoring-breaking threshold voltage during a first anchoring-breaking phase of duration $T_1$, and then a voltage level $V_2$ during a second, selection phase of duration $T_2$ that is capable of inducing either the T texture or the U texture depending on the voltage $V_2$ applied. This therefore corresponds to addressing in non-multiplexed mode.

After application of the control signal, all the 16 pixels of the paraAB4 switched simultaneously, either to the U texture (FIG. 5*a*) or to the T texture (FIG. 5*b*), depending on the voltage $V_2$ applied.

The state shown in FIG. 5*a* (U state) was obtained with $V_1$=15 V, $V_2$=9 V and $T_1$=$T_2$=1 ms. The state shown in FIG. 5*b* (T state) was obtained with $V_1$=$V_2$=15 V and $T_1$=$T_2$=1 ms.

Observation of the Images in Non-multiplexed Mode

It may be seen in FIG. 5 that the pixels switch uniformly over their entire surface. The perfect T switching of the pixels proves that the displacement of the liquid crystal takes place correctly in the immediate vicinity of the interpixel region.

This narrow non-addressed region is therefore not an obstacle to its penetration by the liquid crystal flux, probably owing to its very small width (0.05 mm), whereas the liquid crystal is set in motion on either side by the T-addressed pixels.

Switching of the Pixels by Addressing in Multiplexed Mode

The paraAB4 display produced above was connected in a second experiment to an electronic circuit that generates standard multiplexing signals for the BiNem (similar to those described by Document [3]) as illustrated for example in FIG. 6. In our example, the duration of the column signal $t_c$ was equal to $T_2$. The four row electrodes R1 to R4 and the four column electrodes C1 to C4 of the display were now each connected to one of the eight channels of an electronic card EC shown schematically in FIG. 7. A single row was selected at a time: the row select signal was applied in succession to the four rows of the display in the following order: firstly, row R4, then R3, then R2 and then R1. The column signals were applied simultaneously to the four column electrodes of the display in temporal coincidence with the end of each of the row signals, as described in Document [3]. The pixels then switched to the U or T texture depending on the voltages applied to the columns, as illustrated in FIG. 8.

To facilitate the observations, while avoiding any memory effects, the display was placed in an initial T state by simultaneously addressing all the pixels before the multiplexing signals were applied.

The control signal parameters were adjusted in order to allow optimum switching of the pixels.

Three images were displayed, namely an entirely T image illustrated in FIG. 8*a* (obtained with $V_{1R}$=15 V, $V_{2R}$=11 V and $V_C$=−3 V), an entirely U image illustrated in FIG. 8*b* (obtained by $V_{1R}$=15 V, $V_{2R}$=11 V and $V_C$=+3 V) or a pattern consisting of nine T pixels and seven U pixels illustrated in FIG. 8*c* (obtained with $V_{1R}$=15 V, $V_{2R}$=11 V and $V_C$=±3 V).

Analysis of the Switching Defects in Multiplexed Mode

The display was observed after addressing these three images and the appearance of edge defects on certain of the T pixels was noted.

The edge defects consisted of a parasitic U texture along the edges of the pixel in the brushing direction. They all related to the T-addressed pixels adjacent to a U-addressed pixel. The parasitic U texture is present in the T pixel over a length of about 0.1 mm (see FIG. 9).

Observation of the U pixels shows that these are not affected, nor are the T pixels adjacent to other T pixels.

Impact of the Defects on a High-resolution BiNem Display

The switching defect described above can be a considerable problem in the production of high-resolution bistable displays. In particular, it disturbs the operation of colour BiNem displays. This is because a colour display has three times as many elementary pixels as a black-and-white display of equivalent resolution, and the short side of the elementary pixels of which it is composed is then frequently less than 0.1 mm in standard commercial products. With such a pixel, the size of the edge defect would become equivalent to that of the entire pixel, which is unacceptable.

Switching of a 160×160 BiNem Display Produced According to the Prior Art

Description of a 160-row×160-column BiNem Display Produced According to the Prior Art A BiNem display with a definition of 160 rows×160 columns was produced so as to evaluate the magnitude of the switching defect on smaller pixels. The width of the row electrodes $E_r$ (on the slave plate) of this device was about 0.3 mm, their length was about 55 mm and the insulation between two electrodes was about 0.015 mm. The dimensions of the column electrodes $E_c$ (on the master plate) had the same characteristics (width, length and insulation) as $E_r$. The brushing direction was parallel to the row electrodes. The brushing directions of the master and slave plates were parallel, but in opposite senses.

The display was provided with a rear reflector, a front polarizer and a front illumination device in order to operate in reflective mode—the T texture represented the "on" state (it appeared light) while the U texture represented the "off" state (it appeared dark).

Suitable drive electronics delivering 160 row signals and 160 column signals completed the device and allowed the display to be addressed in multiplexed mode.

Analysis of the Switching Defects of the 160-row×160-column BiNem Display in Multiplexed Mode As in the previous case, observation of the pixels under high magnification showed the presence of edge defects.

These edge defects also consisted of a parasitic U texture along the left and right edges, in the brushing direction, of all the T-addressed pixels adjacent to a U-addressed pixel (see FIG. 10). This defect appears only in multiplexed mode and gives a visual impression of poorly defined columns with a tendency to spill over. The parasitic U texture extends over about 0.08 mm.

Theoretical Study of the Origin of the Switching Defects in BiNem Displays Produced According to the Prior Art After many studies, manipulations and experiments, the inventors have interpreted the inhibition described above in the selection of the T texture along the left and right borders of the pixels in the direction of hydrodynamic flow of the liquid crystal, in a conventional display, as due to rapid damping of the liquid-crystal displacement at the boundaries of the pixel when being switched into the T state.

The flow of liquid crystal at the edge of the pixel, which moves in the direction of alignment, is disturbed by the adjacent regions that do not switch simultaneously into the same texture. In these regions, the displacement of the liquid crystal is very small. This reduction in the flow of liquid crystal at the pixel borders reduces the hydrodynamic coupling between master plate and slave plate and prevents those regions of the pixel where the flow of liquid crystal becomes too slight to switch into the T texture.

More precisely, the T texture is obtained when, when the electric field is turned off, the flow near the slave plate creates a hydrodynamic shear torque opposite to that exerted by the anchoring and stronger in modulus than the latter. At this instant, the elastic torque of the anchoring is non-zero—it corresponds to the residual tilt angle under a field and tends to induce the U texture. The hydrodynamic shear is proportional to the velocity gradient close to the slave plate.

FIG. 11 shows the velocity v of the liquid crystal in the pixel, the time t and xyz an orthonormal reference frame. The master and slave plates are parallel to the xy plane and the alignment direction is in the x direction. The edge of the pixel is defined by x=0, it being assumed that the pixel extends indefinitely to negative x values, the plane of the slave plate SP is defined by z=0 and the plane of the master plate MP is defined by z=d (the thickness of the cell).

The velocity obeys a diffusion equation:

$$\rho\frac{\partial v}{\partial t} = \eta\frac{\partial^2 v}{\partial z^2}$$

where η is the viscosity of the liquid crystal and ρ is its density. Since η≈0.1 Pa·s and ρ≈$10^3$ kg/$m^3$, the velocity propagation time from one plate to the other over a distance d≈1 μm is τ=10 ns. This time is absolutely negligible compared with the times for orienting the liquid crystals. It is therefore possible to consider that the velocity gradient close to the slave plate SP, and therefore the hydrodynamic shear torque, depends on time only as $v_0$, the velocity close to the master plate MP:

$$\frac{\partial v_e}{\partial z} = \frac{v_0}{d}$$

When the velocity close to the master plate reaches or exceeds a critical velocity, the centre of the pixel switches to the T texture. Otherwise, the centre of the pixel switches to the U state.

The situation is different at the edge of the pixel. We shall consider the case of a pixel edge oriented parallel to the flow and then the case of a pixel edge oriented perpendicular to the flow.

If the edge is oriented parallel to the flow, the liquid crystal close to this edge, but outside the pixel, is driven by the flow close to this edge inside the pixel. Conversely, the flow inside is slowed down. However, the coupling in the y direction perpendicular to the edge is viscous like the coupling in the z direction that launches the flow from the master plate. The equation for these couplings is a Laplace equation; the effect will therefore be visible in the pixel and on the outside only over a band whose width is close to the thickness d, i.e. a micron on either side. A corrective factor appears because of the anisotropy of the liquid crystal viscosities and of the difference in orientation of the molecules between the inside and the outside of the pixel. In this narrow band, the flow is less strong and the T texture should be difficult to obtain. However, the electrical edge effects of the electrode or mechanical orientation defects exit at the same place and over a band of the same width, since these effects are also solutions of Laplace equations; they may mask the reduction in flow efficiency.

Along the edge of a pixel oriented perpendicular to the flow, the flow of material leaving or entering the pixel takes place only by compressing or dilating the liquid crystal in a band on either side of the edge. This constraint increases with time and may become strong enough to deform the glass plates.

The first microseconds of the flow are decisive for switching of the texture. At room temperature, simulations show that about 10 μs after the field has been turned off, the molecules have started to tilt irreversibly in the direction giving the T texture, or in the opposite direction giving the U texture. A time of this order is short enough for the glass plates to be considered as being infinitely stiff—only the liquid is compressed. It is also long enough to neglect the inertia terms. The velocity diffusion equation can then be written as:

$$\eta\frac{\partial^2 v}{\partial z^2}+\chi\frac{\partial^2 \xi}{\partial x^2}=0$$

where $$v=\frac{\partial \xi}{\partial t}$$

where η is the viscosity of the liquid crystal, χ is its compressibility and ξ is the elementary displacement of the liquid-crystal layer at the height z. The boundary conditions are □=0 for z=0 (the velocity is zero on the slave plate). Close to the master plate in the pixel, $v=v_0$ (for z=d and x<0) and outside v=0 (for z=d and x>0). By taking account of the geometry of the boundary conditions, the solution of this equation depends only on two variables and is of the form:

$$\frac{v}{v_o}=f\left(\frac{z}{d},\frac{x}{x_o}\right)$$

$$x_o=d\sqrt{\frac{\chi t}{\eta}}$$

where $v_0$ is arbitrary, this being the velocity induced by the rotation of the molecules close to the master plate. $x_0$ is the scale in x. FIG. 12 shows the function $f(x/x_o)$, hence the velocity of the edge of a pixel as a function of the distance from this edge. This velocity is plotted for the master plate and for nine positions in z between master plate and slave plate. The $x/x_o$ scale goes from $-\sqrt{2}$ to $\sqrt{2}$. For a conventional liquid crystal, η/χ=0.1 ns if the cell has a thickness d=1 μm, at the time t=5 μs, the edges of the graph are at ±300 μm. In the pixel, at 300 μm the velocities are those of the centre of the pixel and they remain proportional to the distance from the slave plate. At −100 μm from the edge, the velocity close to the slave plate is reduced by 25%, the gradient is reduced in the same proportions and the switching to the T state may be impossible. We should point out that right at the edge of the pixel the velocity generated by the master plate is halved at any instant. At 100 μm from the edge of the pixel on the outside of the latter, there is Couette flow. The sign of the velocity is not involved in the velocity profile—the flow leaving the pixel has the same effect as that entering it.

In conclusion, during the time when the fall of the molecules on the master plate causes the switching, its movement is entirely transmitted to the slave plate except over a band of about 100 μm in width along the edges of the pixels perpendicular to the flow.

The equations are linear in this simple case in which the viscosity is considered as being isotropic. The solution of a more complicated problem is constructed by adding the simple solutions together.

For example, if two pixels lie along the x axis and switch at the same instant from the H state to the T state, the flows are added; since the interpixel distance is less than 100 μm, the switching to the T state is obtained close to the two facing edges. This example is encountered in the previous experiments in which the brushing direction $D_2$ and the direction $D_1$ of the row electrodes coincide—between two pixels on the same row switching to the T state at the same time, no U band appears.

A very advantageous practical example corresponds to the switching of a pixel to the T state if it is isolated or if the pixel that follows it in the flow direction switches to the U state at the same instant. The curve in FIG. 12 shows that the velocity transmitted to the slave plate SP is halved at the edge of the pixel in question, as there is no flow in the adjacent pixel. If the electrical signal is adjusted in order to make the middle of the pixel switch, its edge will pass into the U state. This example was encountered in the previous experiments—at the edge of the T pixel adjacent to a U pixel in the same row that has therefore switched at the same instant, a U band appears. The appearance of the bands in the two previous experiments in which the brushing direction $D_2$ and the direction $D_1$ of the row electrodes coincide is understood. This arrangement favours the coupling of adjacent pixels during addressing by the same liquid-crystal flow, since the pixels sharing a common row electrode are addressed simultaneously.

Impact on the Production of Gray Levels

This example presents another benefit: if the pixels operate independently, it is possible to adjust the electrical signal in order to make part of the pixel switch to the T state and thus obtain gray tones by progressive variation of the switched surface of the pixel. Just above a velocity threshold on the master plate MP, the centre of the pixel switches to the T state while an approximately 0.1 mm band along the edges switches to the U state. Well above the threshold, the entire pixel will switch to the T state.

It has been seen that the T texture is obtained everywhere where the shear, and hence the velocity of the liquid-crystal displacement, exceeds a certain critical value when the H texture is relaxed.

In the case of a display with a gray level, it is important for the final optical state of each pixel, defined by the ratio of the area occupied by the T texture to the total area of the pixel, to be able to be precisely controlled for each of the pixels of the screen. Otherwise, the display uniformity of an image for a given gray level would leave something to be desired (in other words, the number of separate gray levels actually available would be reduced).

In the case of parallel orientation, the displacement of the liquid crystal takes place along the rows, the electrodes-of the master plate MP. It was seen that the displacement velocity giving the T state is unaffected when a neighbouring pixel in the flow direction is addressed in order also to switch to the T state. However, this velocity is reduced locally below a critical value at the boundaries with possible neighbouring pixels addressed for switching to the U state.

It follows from the foregoing that a difficulty immediately arises in obtaining uniform gray levels in parallel orientation, namely all the pixels of the row must be addressed in the same T state, otherwise the switching state of a T pixel neighbouring a U pixel would be defective, as regards its gray level, owing to the presence of a parasitic U region near its boundary with the pixel addressed in the U state.

It is clear that such a constraint is unacceptable for a display with gray levels. A BiNem display with parallel orientation is therefore unsuitable for a display with gray levels, at least in the case of small pixels (for example those with sides of less than 1 mm), for which the area of the parasitic U texture along the edge of the pixel is significant.

BASIS OF THE INVENTION

To alleviate the inherent drawbacks of the prior art, the present invention proposes a bistable nematic liquid-crystal matrix display device in which the transition into at least one of the two bistable states is brought about by displacement of the liquid crystal parallel to the surfaces of the device, characterized in that it comprises a system for addressing the various elements of the display, such that it does not switch simultaneously two elements that are contiguous in the direction of flow of the material, and thus allows better control of the flows at the pixel edges.

According to other advantageous features of the present invention:

- the addressed rows of the device are inclined relative to the direction of flow of the liquid crystal, advantageously perpendicular to this direction;
- the direction of orientation of the liquid-crystal molecules is inclined relative to the addressed rows, advantageously perpendicular to them;
- the orientation of the molecules is obtained using one of the means chosen from the group comprising: a brushing operation, a polymer layer activated by polarized light, an oriented film deposited by vacuum evaporation, a grating; and
- the device is of the BiNem display type (however, it may also apply to any liquid-crystal display using hydrodynamic effects to switch between textures).

According to yet other advantageous features of the present invention, the The device as claimed in the present invention includes means capable of applying control signals suitable for controlling the magnitude of the liquid-crystal displacement and progressively controlling the extent of one of the two stable states within each of the pixels, so as to generate controlled gray levels inside each of said pixels.

The aforementioned means may operate by modulating various control signal parameters, and especially the voltage level of the column signals and/or the duration and/or the phase thereof.

The present invention also relates to a method of display using a bistable nematic liquid-crystal matrix device in which the transition to at least one of the two bistable states is brought about by displacement of the liquid crystal parallel to the surfaces of the device, characterized. in that it includes a step of addressing the various elements of the display using electrical signals such that the device does not switch simultaneously two elements that are contiguous in the direction of flow of the material.

DETAILED DESCRIPTION OF THE INVENTION

Other features, objects and advantages of the present invention will become apparent on reading the detailed description that follows and in conjunction with the appended drawings, given by way of non-limiting examples and in which.

Figure 5:
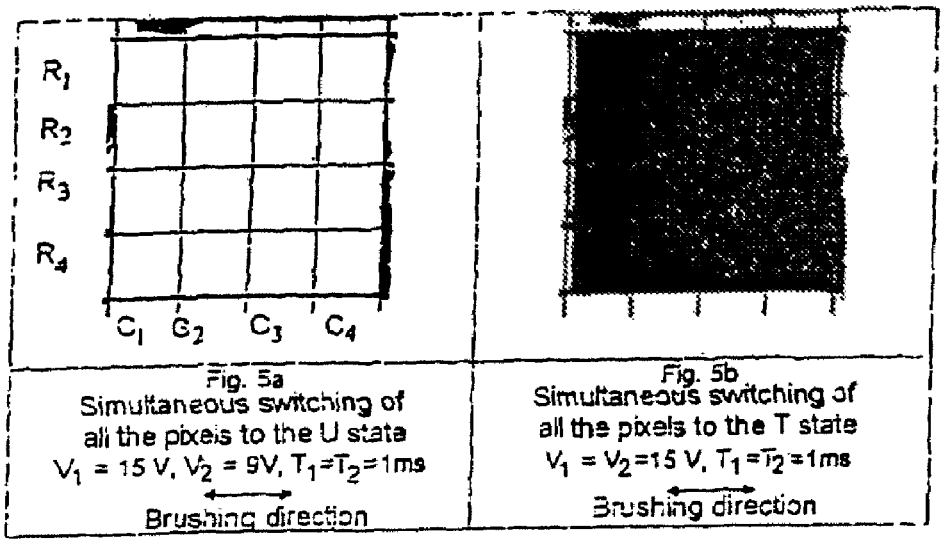
PRIOR ART Figure 5 :
Figure 7:
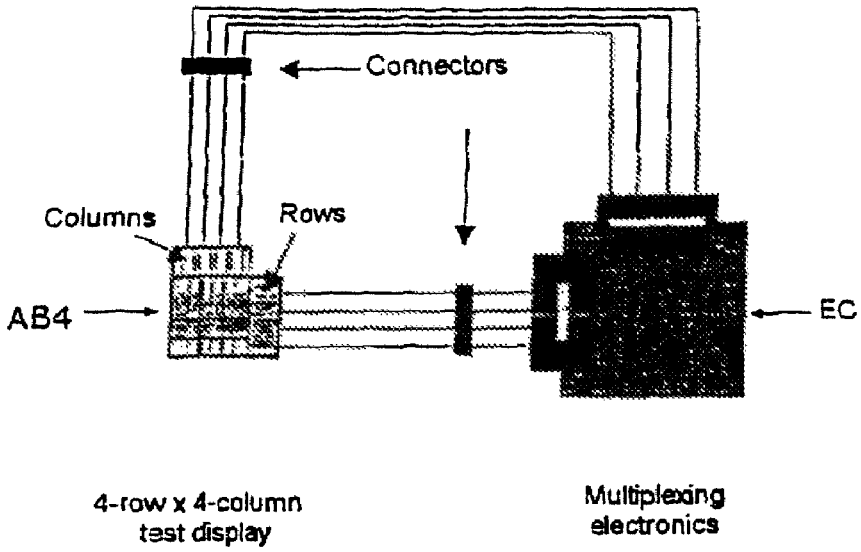
Figure 8:
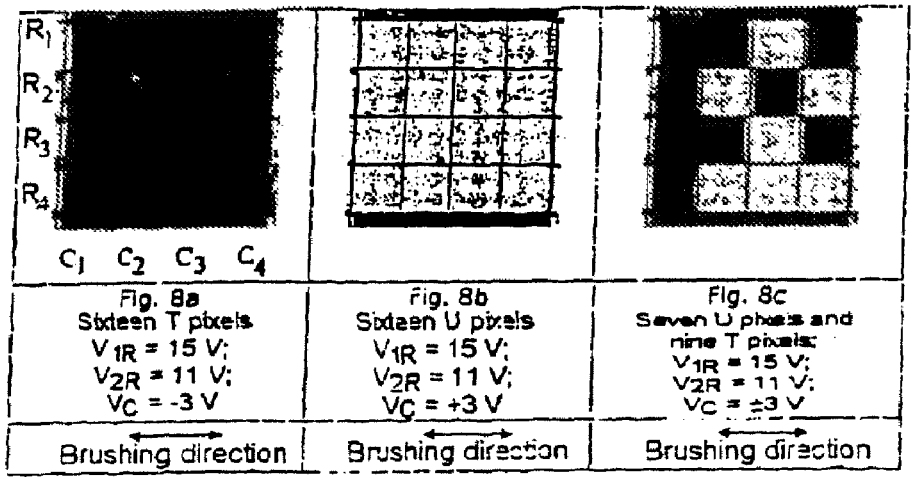
PRIOR ART Figure 8:
Figure 9:
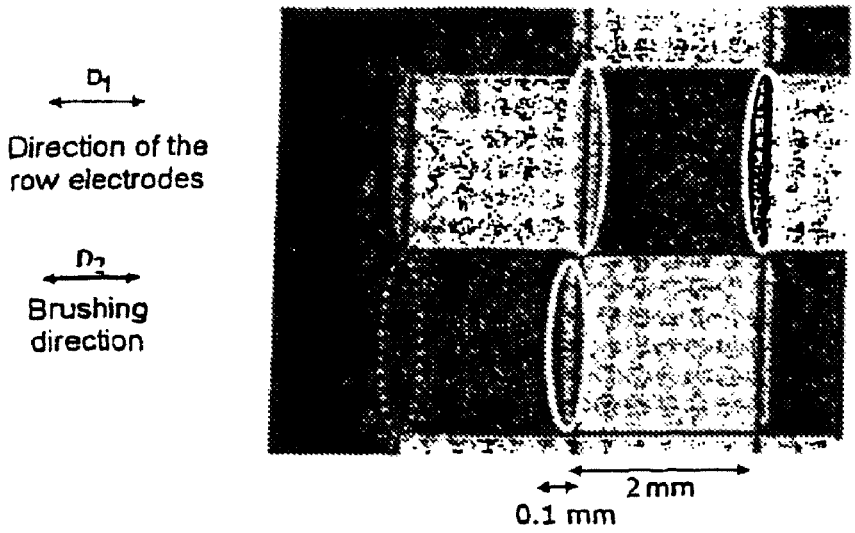
Figure 10:
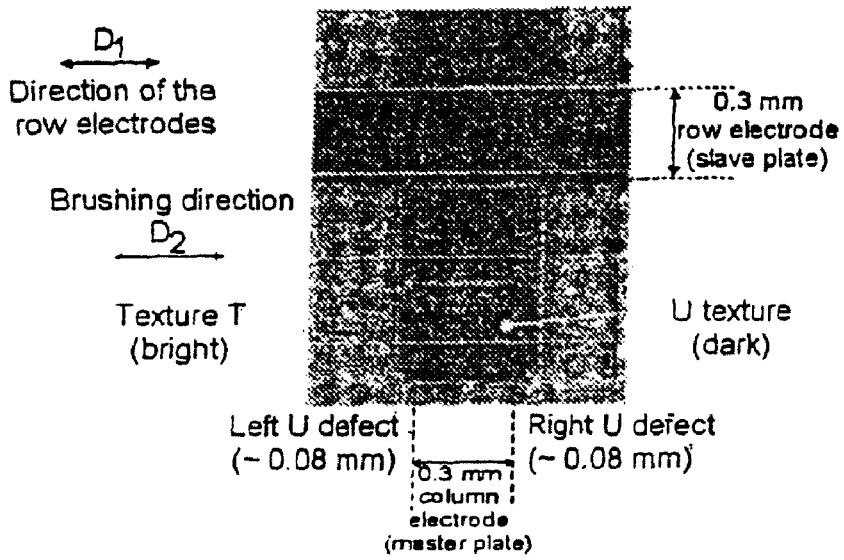
PRIOR ART Figure 10 :
Figure 11:
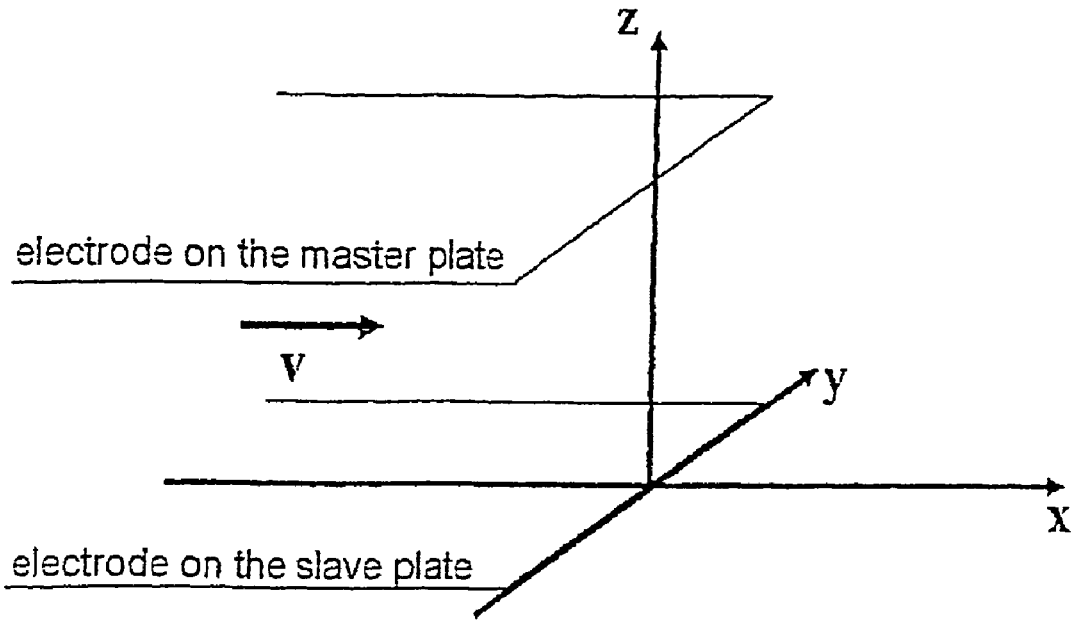
Figure 12:
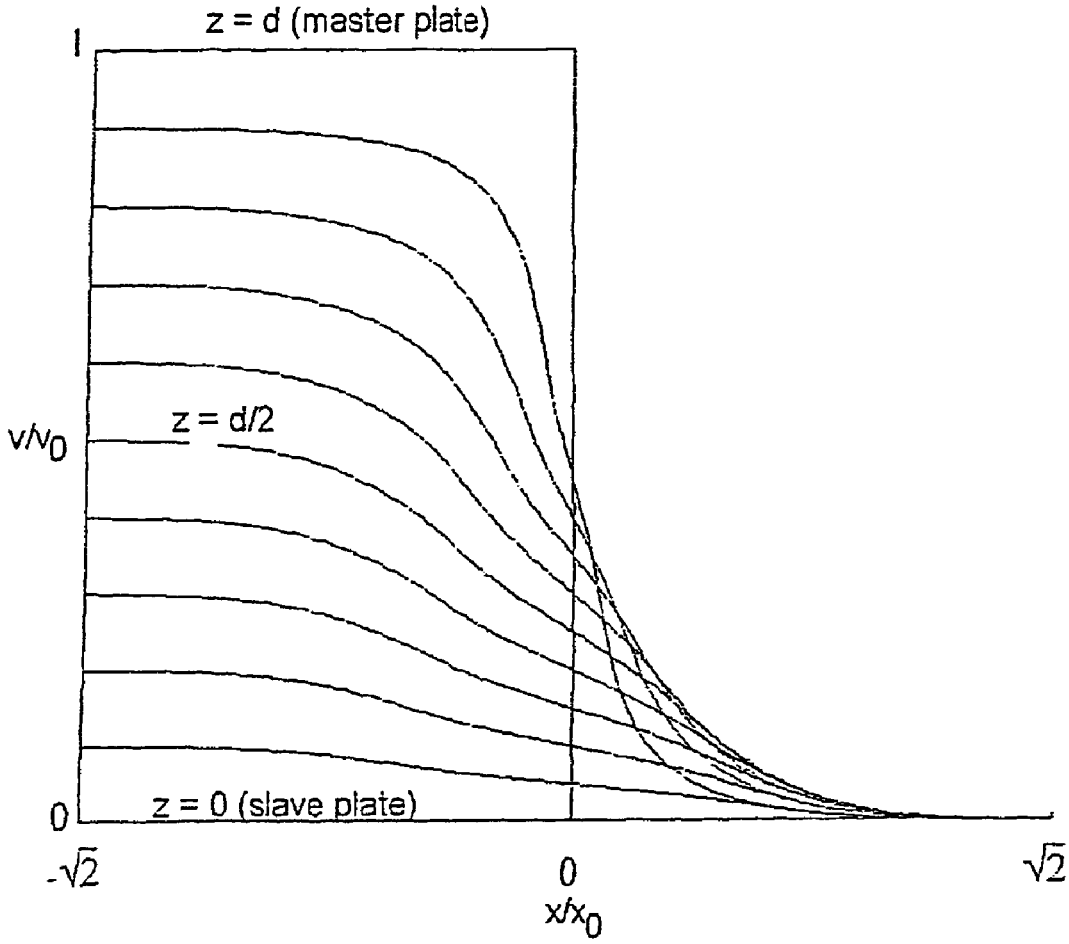
Figure 13:
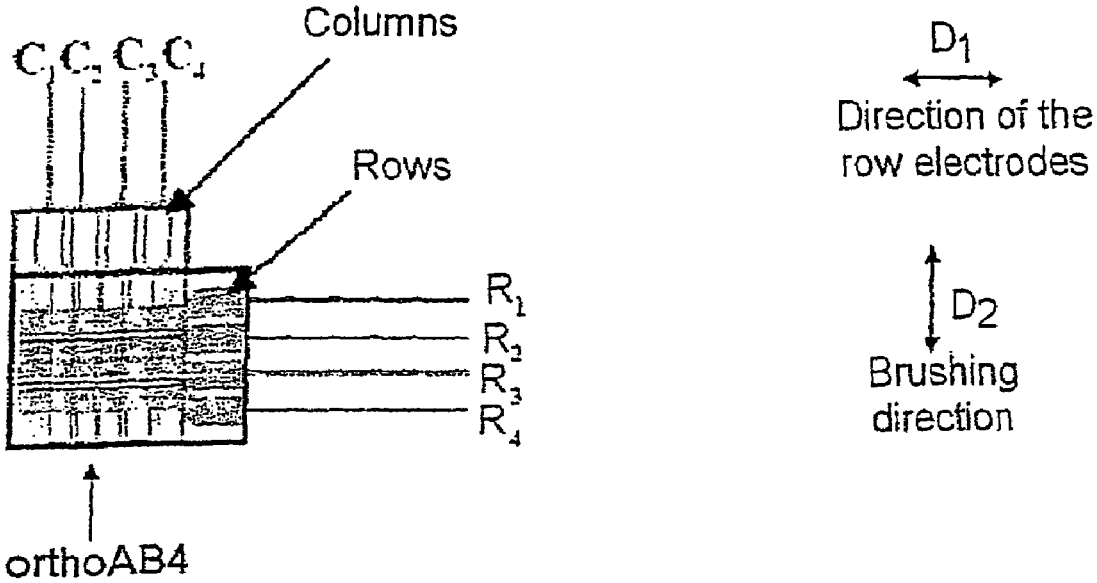
Figure 14:
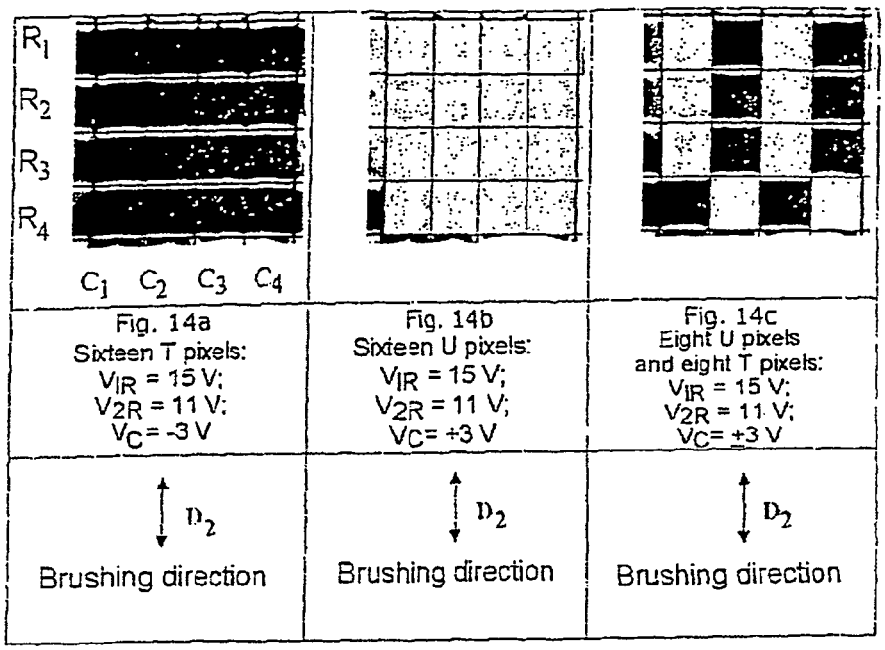
Figure 15:
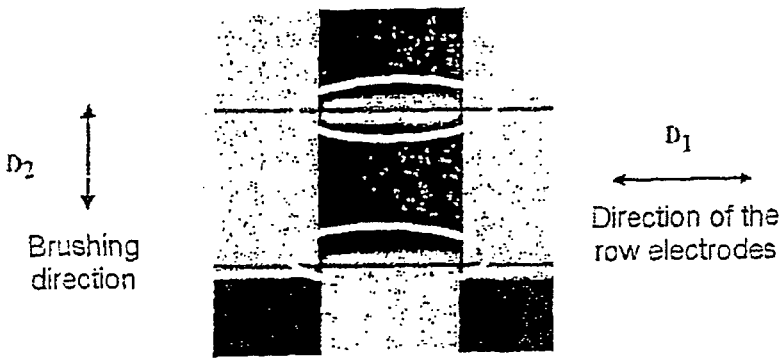
Figure 16:
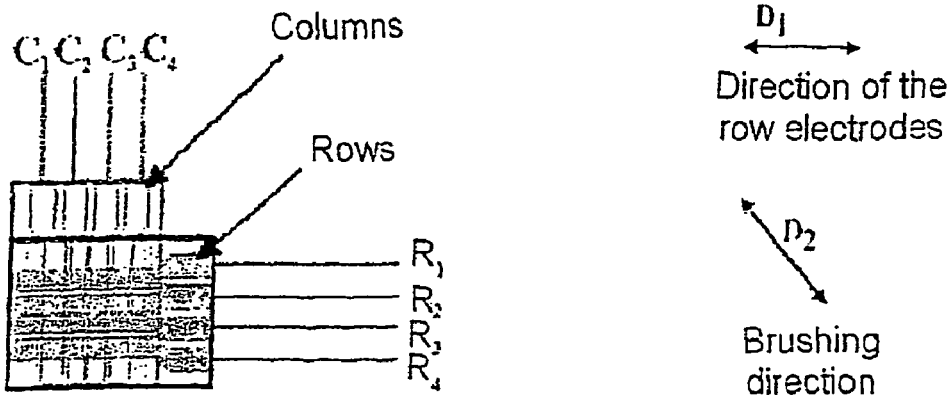
Figure 18:
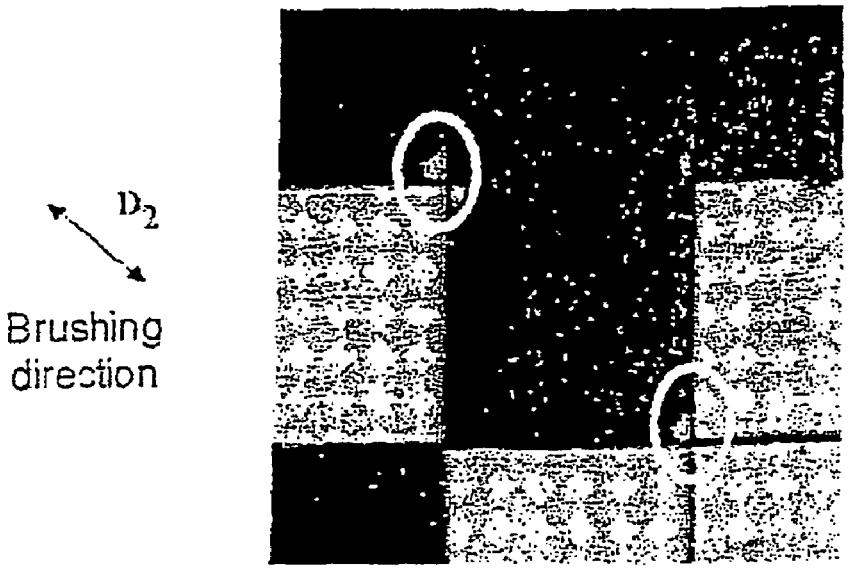

FIG. 5*a* shows the resulting state of the display in the U texture;

FIG. 5*b* shows the resulting state of the display in the T texture;

FIG. 6 shows the signals for multiplexing a matrix BiNem display;

FIG. 7 shows schematically a test set-up with multiplexing signals on the same display according to the prior art;

FIG. 8*a* shows the resulting state of the display activated so that the 16 pixels are in the T state;

FIG. 8*b* shows the resulting state of the display activated so that the 16 pixels in the U state;

FIG. 8*c* shows the resulting state of the display activated so that 9 pixels are in the T state and 7 pixels are in the U state;

FIG. 9 shows in detail pixel edge defects, on the left and the right of a pixel in the direction of brushing;

FIG. 10 shows a switching defect both on the left and the right on pixels of a 160-row×160-column display;

FIG. 11 shows the velocity v of the liquid crystal in the xyz reference frame;

FIG. 12 shows the velocity v of the liquid crystal at an instant, at various positions between the slave plate and the master plate, as a function of the distance x from the edge of the pixel;

FIG. 13 shows schematically a 4-row×4-column BiNem display according to the present invention and illustrates in particular the direction $D_1$ of the row electrodes and the orthogonal brushing direction $D_2$;

FIG. 14*a* shows the resulting state of the display actuated-so that 16 pixels are in the T state;

FIG. 14*b* shows the resulting state of the display actuated so that 16 pixels are in the U state;

FIG. 14*c* shows the resulting state of the display actuated so that 8 pixels are in the T state and 8 pixels are in the U state;

FIG. 15 shows in detail the pixel edge defects, on the left and on the right of a pixel in the brushing direction, for a brushing direction $D_2$ perpendicular to the direction $D_1$ of the row electrodes;

FIG. 16 shows schematically a 4-row×4-column BiNem display according to a variant of the present invention and illustrates in particular the direction $D_1$ of the row electrodes and the 45° brushing direction $D_2$;

FIG. 17*a* shows the resulting state of the latter display actuated so that 16 pixels are in the T state;

FIG. 17*b* shows the resulting state of the same display actuated so that 16 pixels are in the U state;

FIG. 17*c* shows the resulting state of the display actuated so that 9 pixels are in the T state and 7 pixels are in the U state;

FIG. 18 shows in detail the pixel edge defects that can be seen on this display;

FIG. 19 shows the geometric advantage obtained with a display according to the invention, by comparing a "left-right" edge effect according to the prior art illustrated in FIG. 19*a* with a "top-bottom" edge effect according to the present invention, illustrated in FIG. 19*b;*

Figure 4:
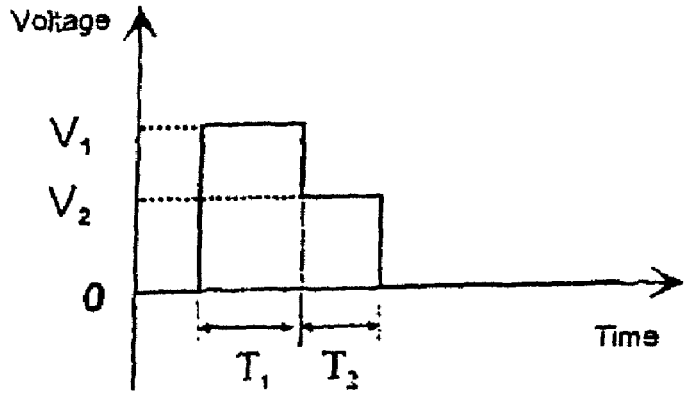
FIG. 4 shows schematically conventional control signals for simultaneously switching the pixels of this display.
Figure 20:
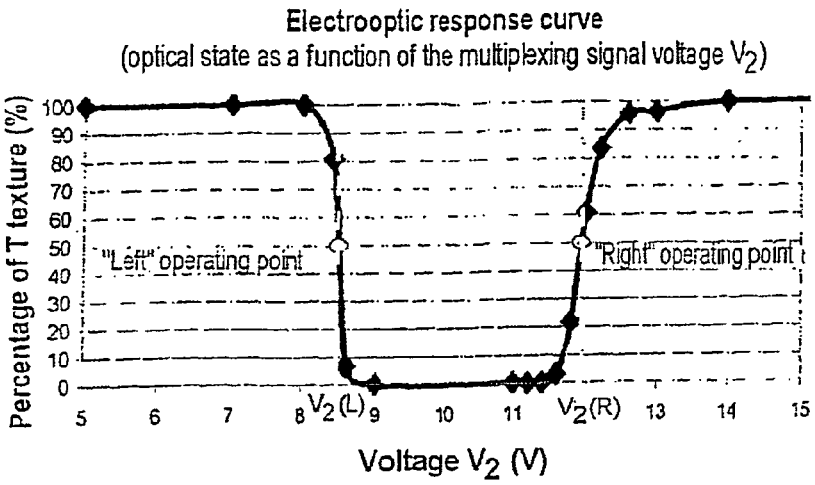
Figure 21:
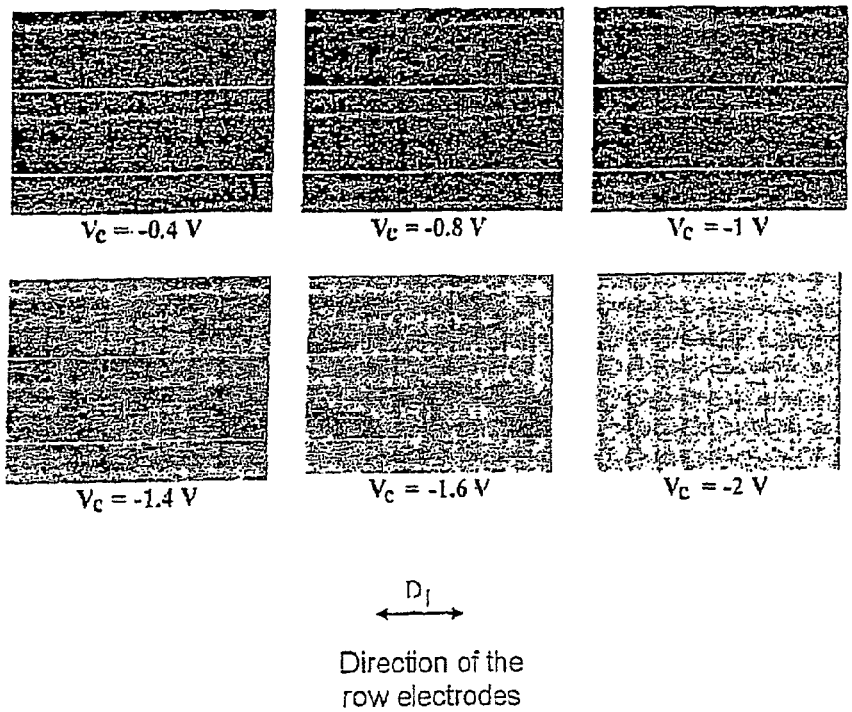
Figure 22:
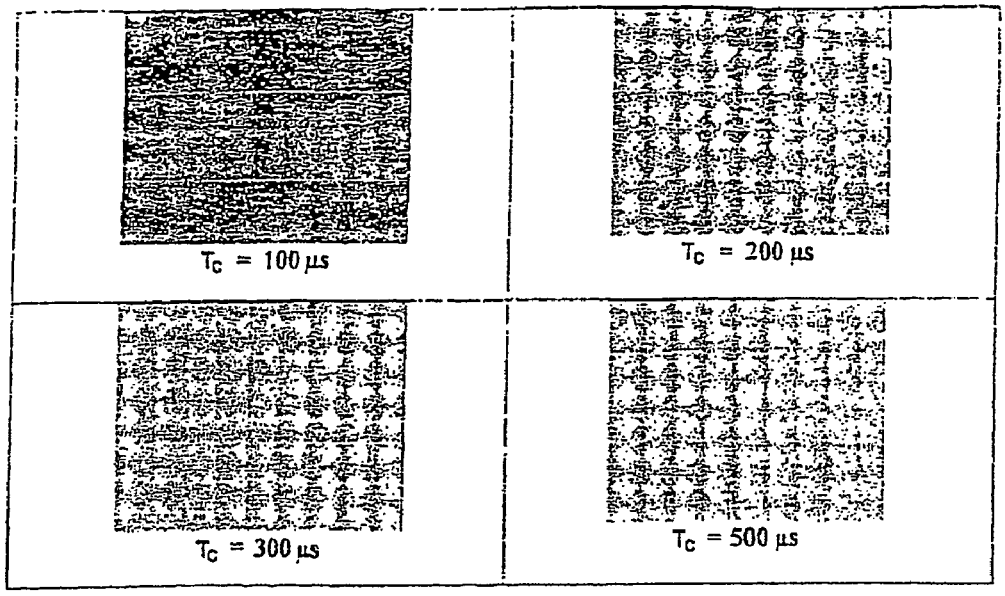
Figure 23:
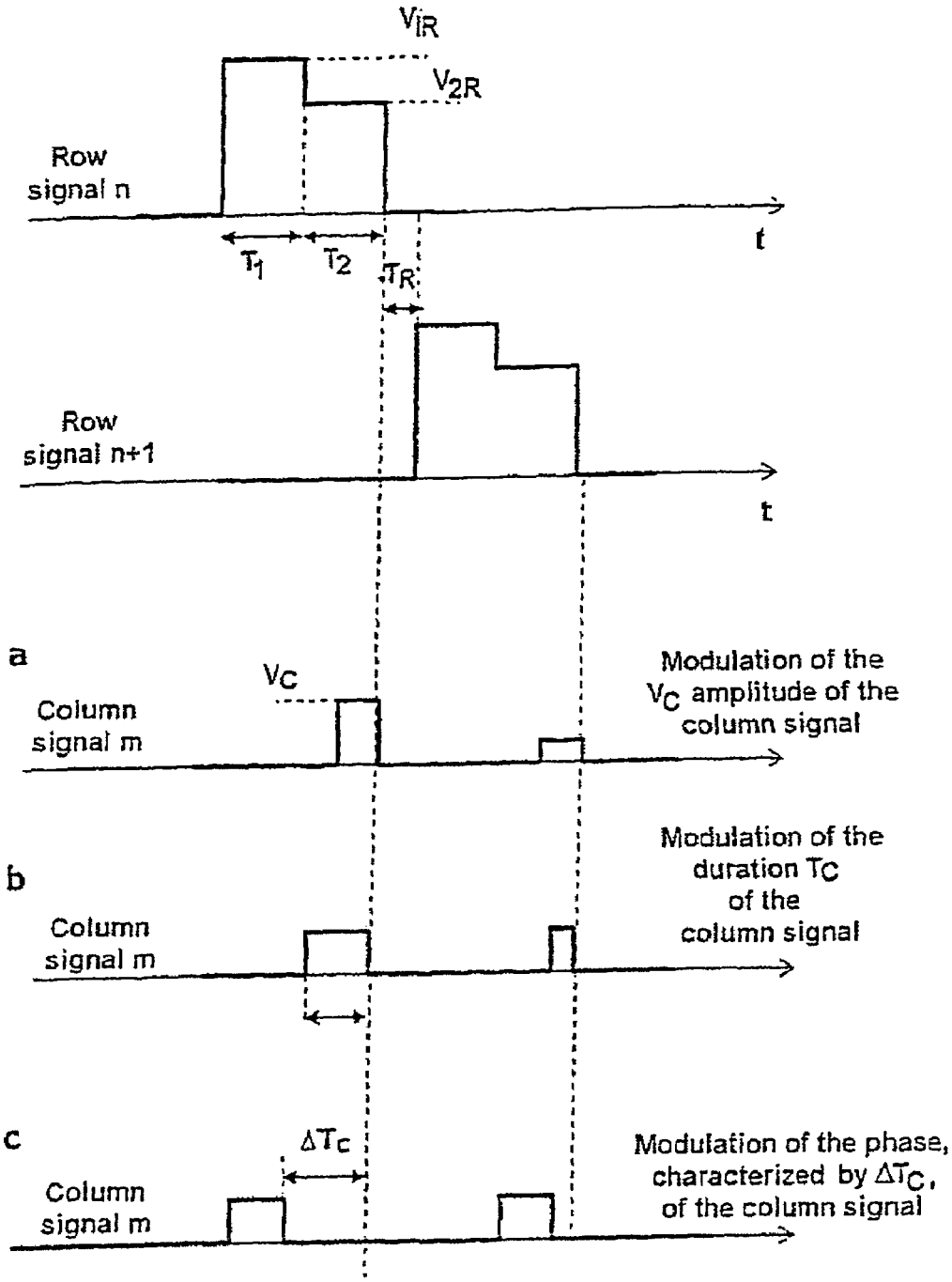
Figure 24:
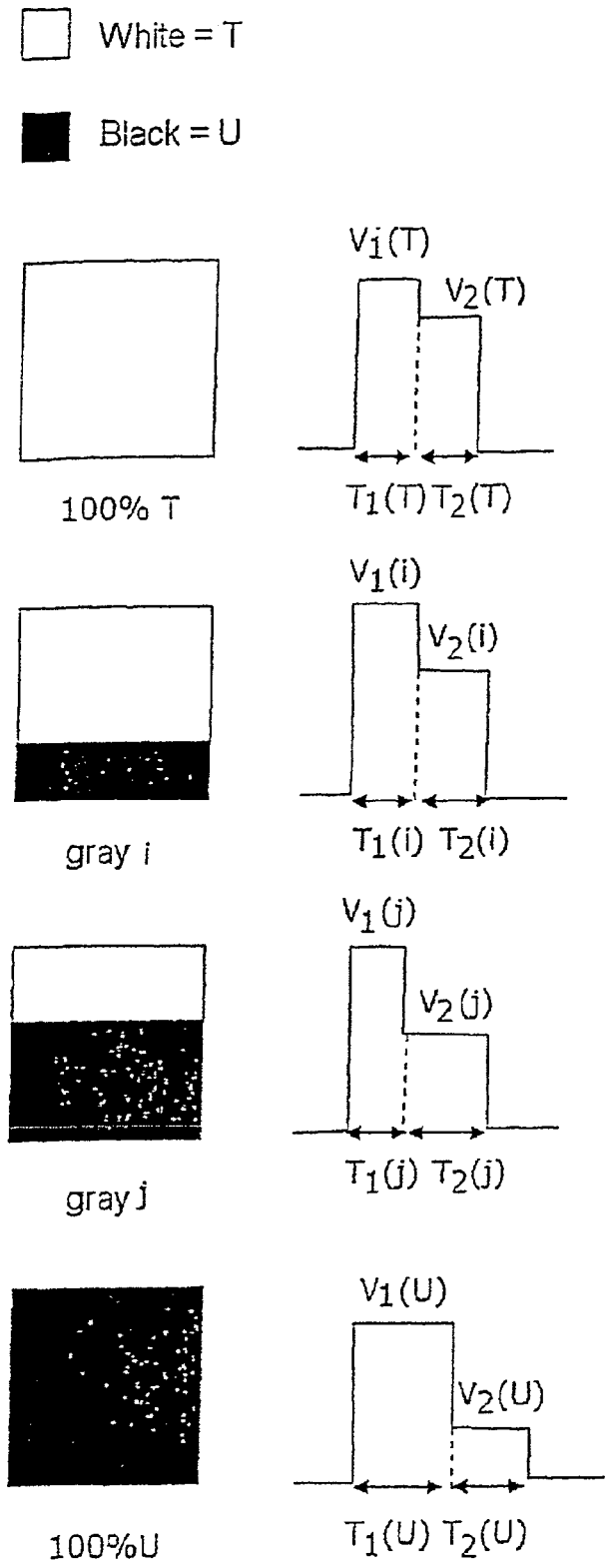
Figure 25:
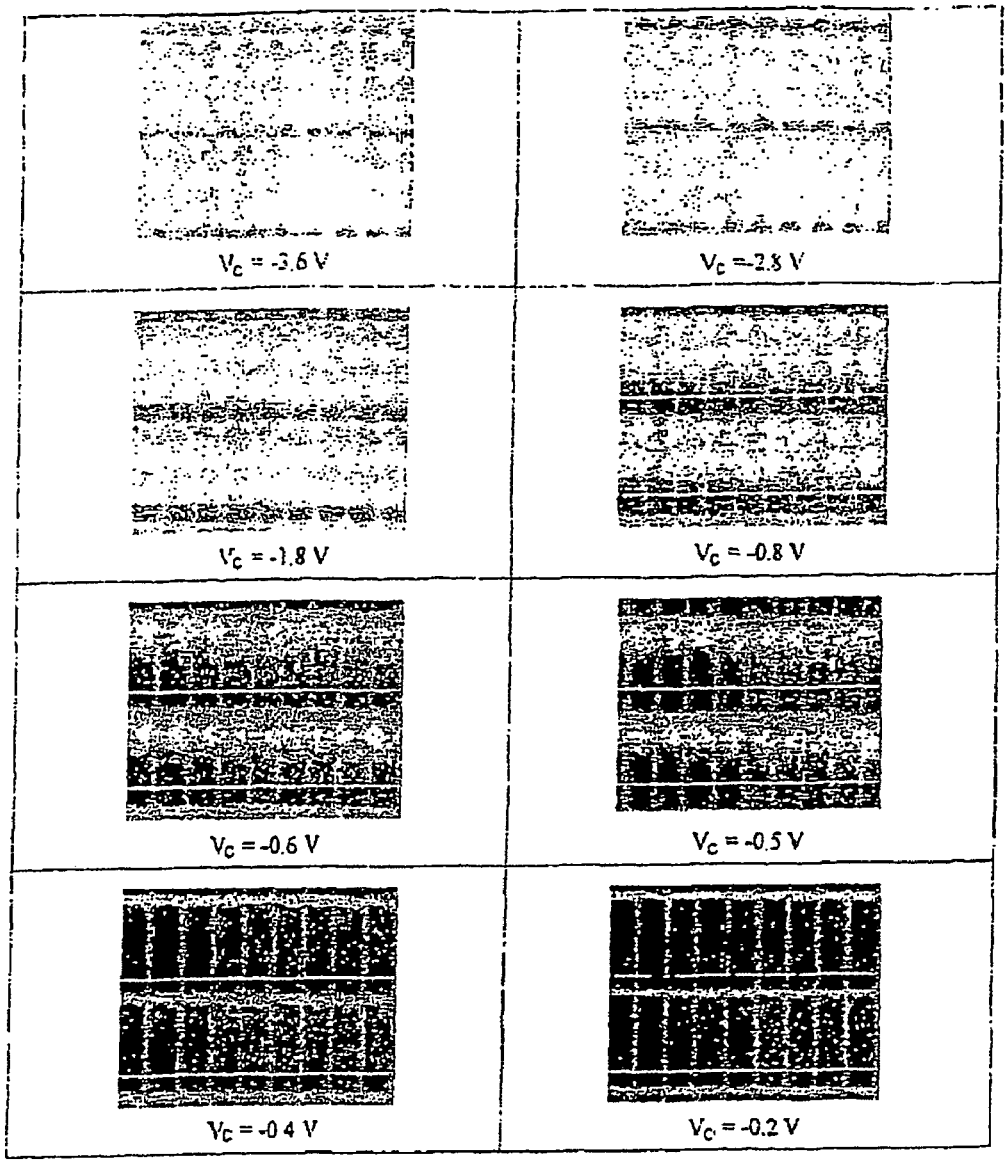
Figure 26:
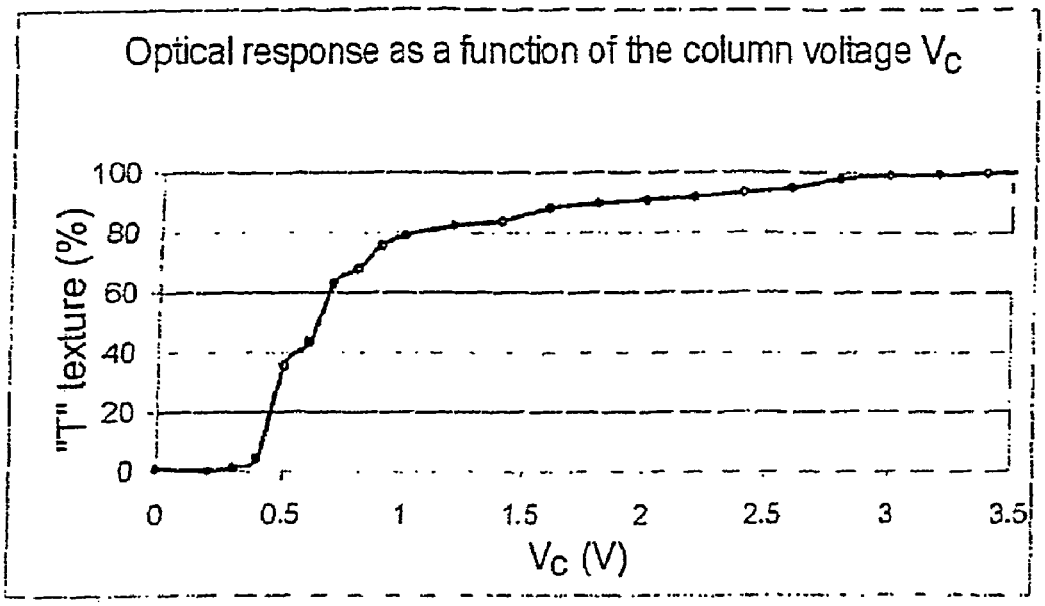
Figure 27:
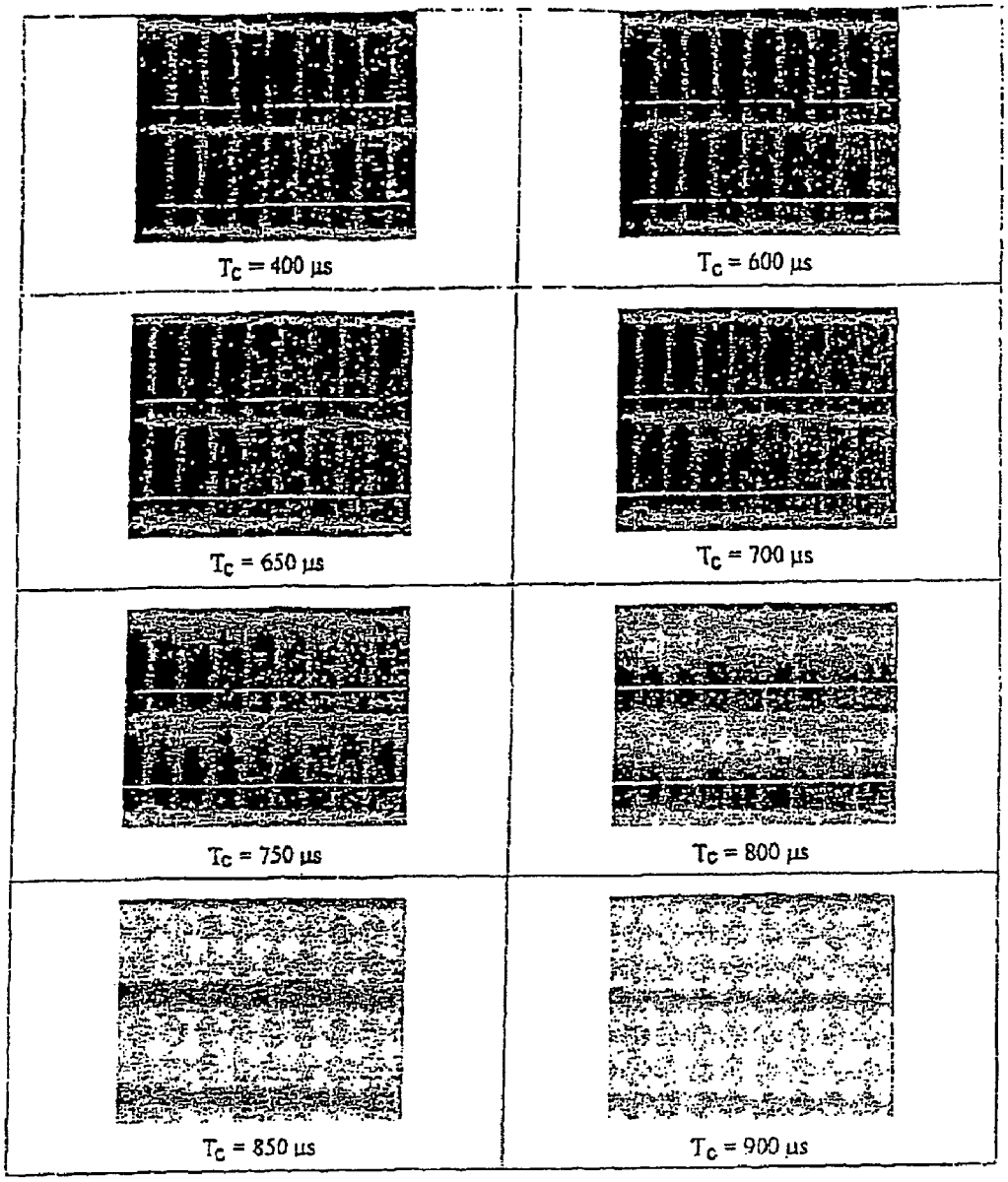
Figure 28:
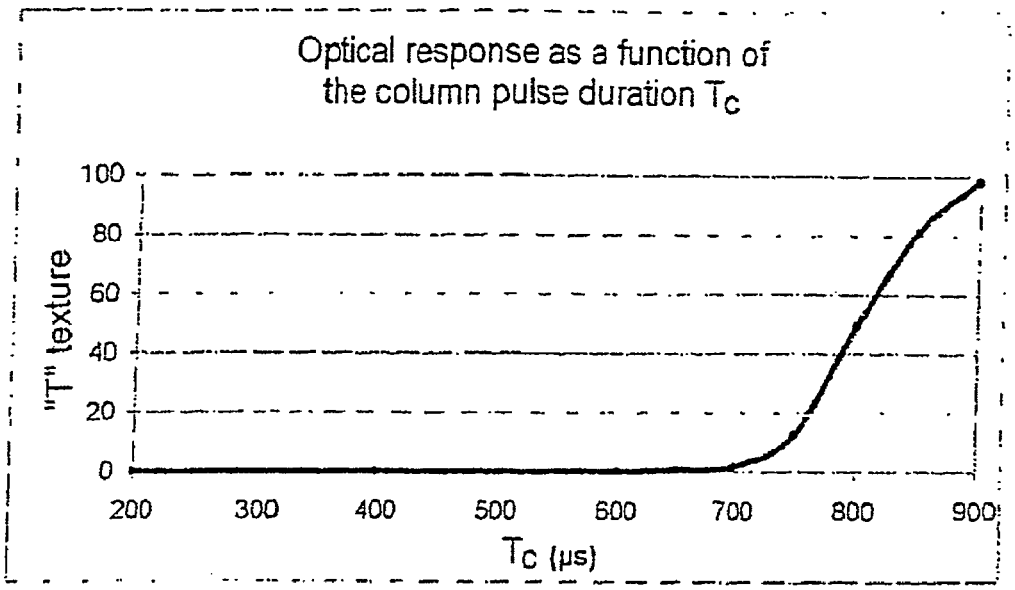
Figure 29:
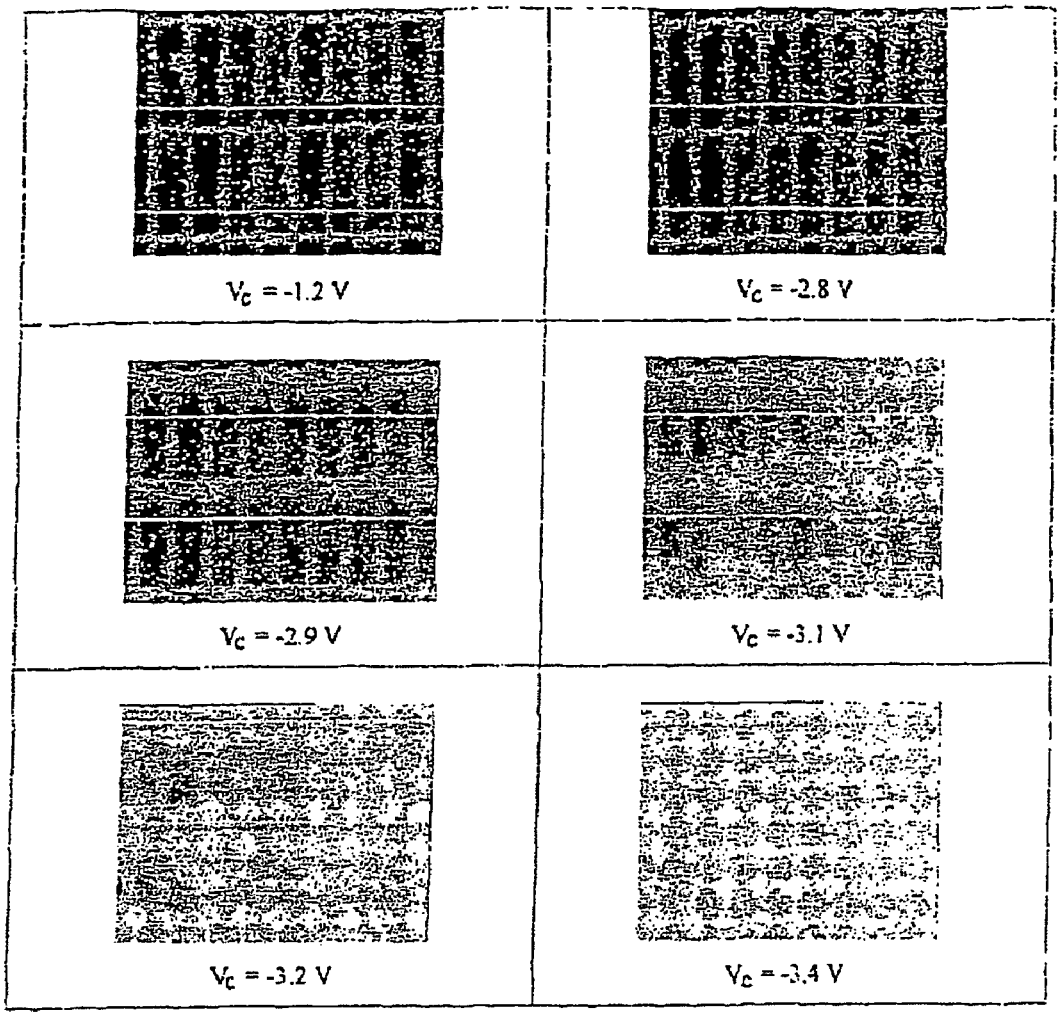
Figure 30:
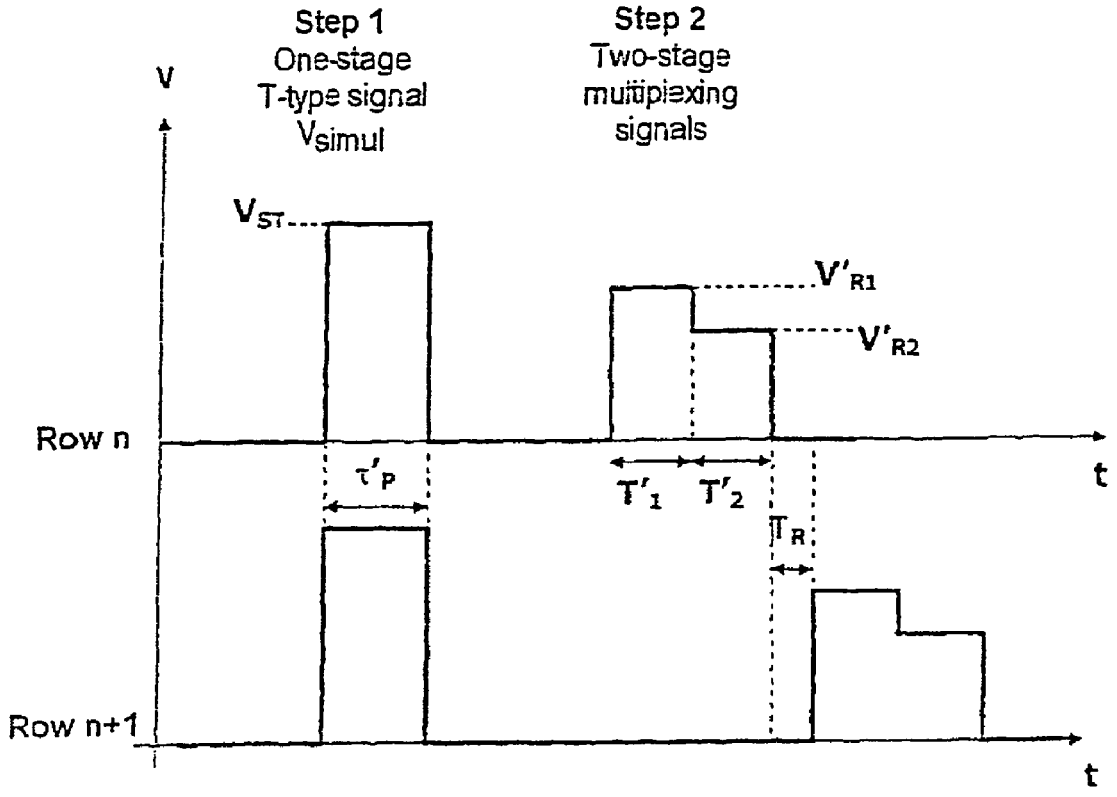
Figure 31:
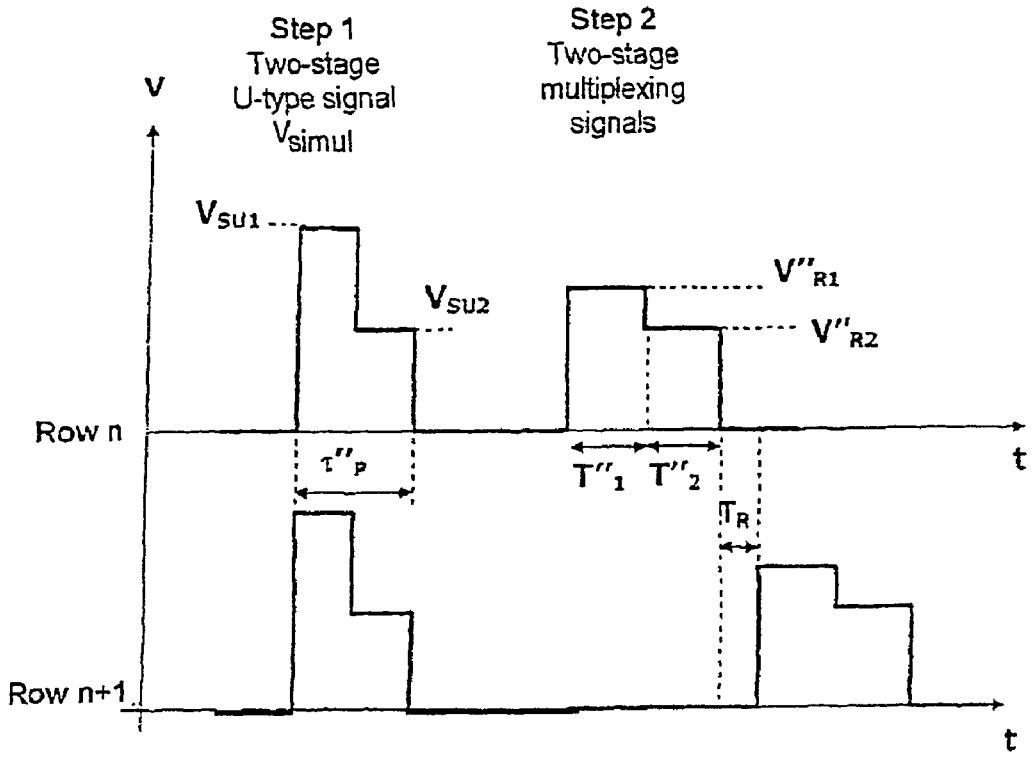
Figure 32:
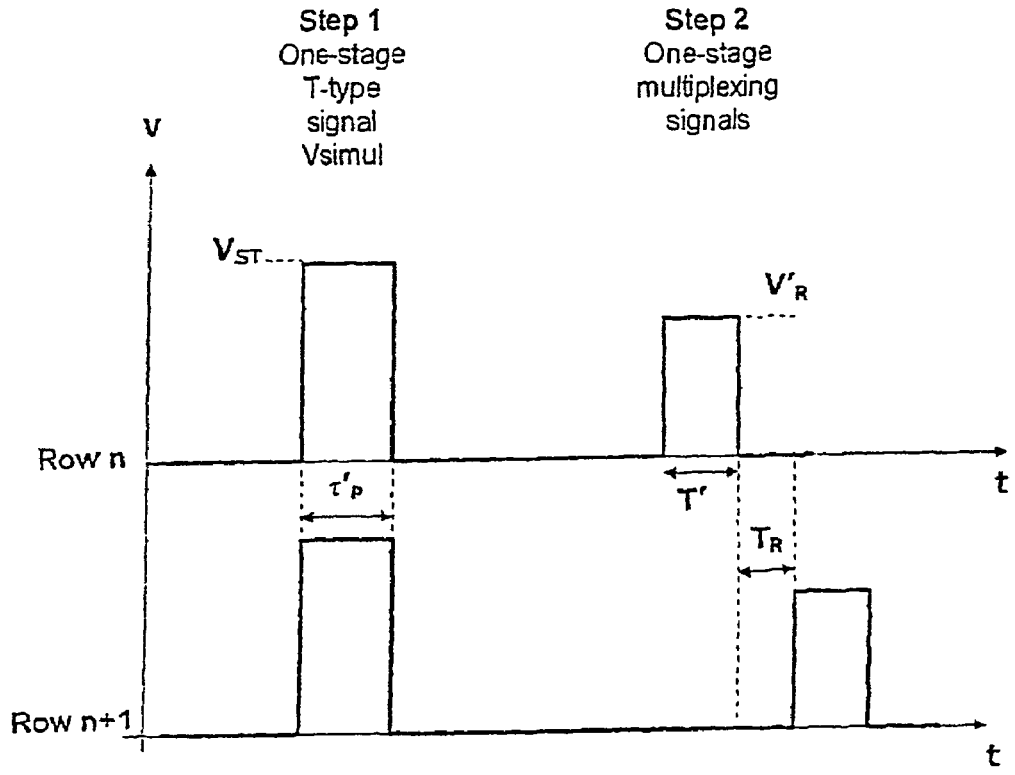
Figure 33:
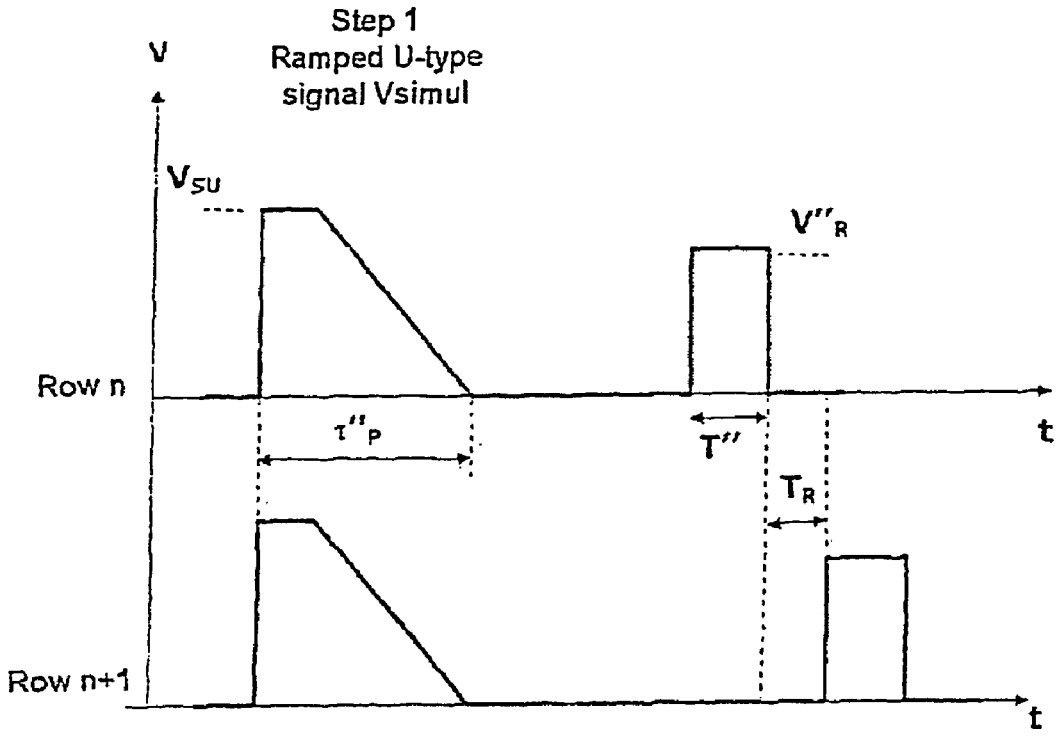
Figure 34:
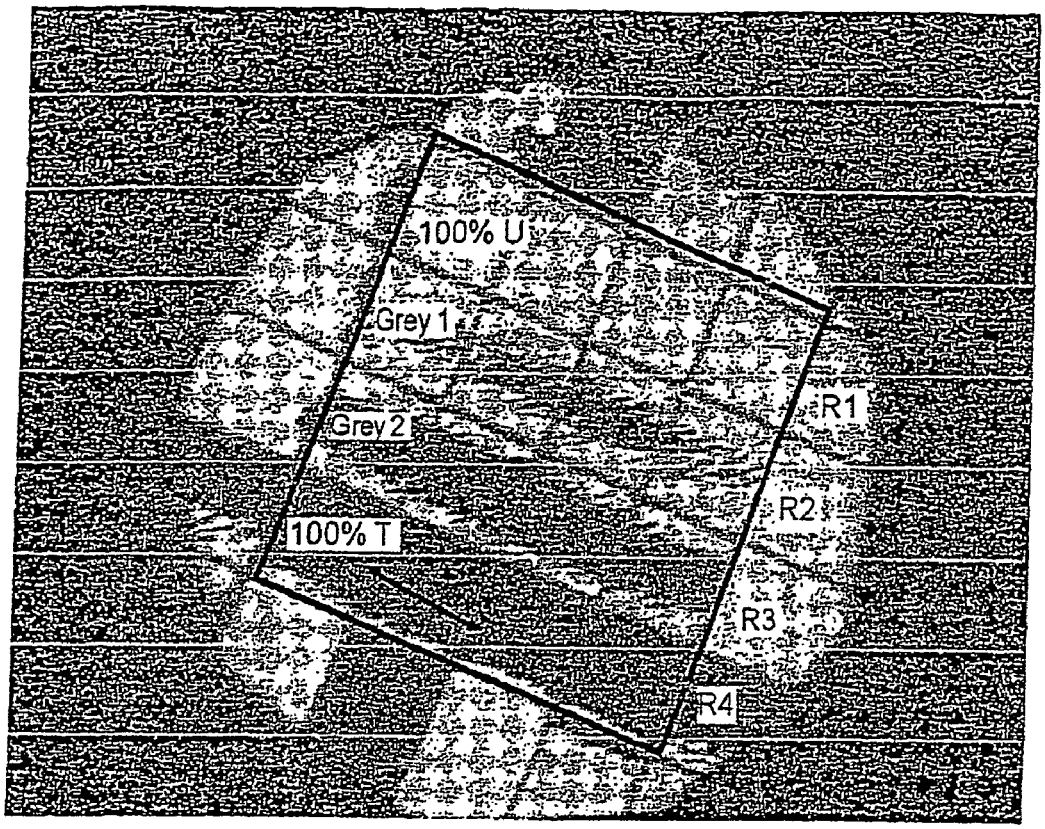
Figure 35:
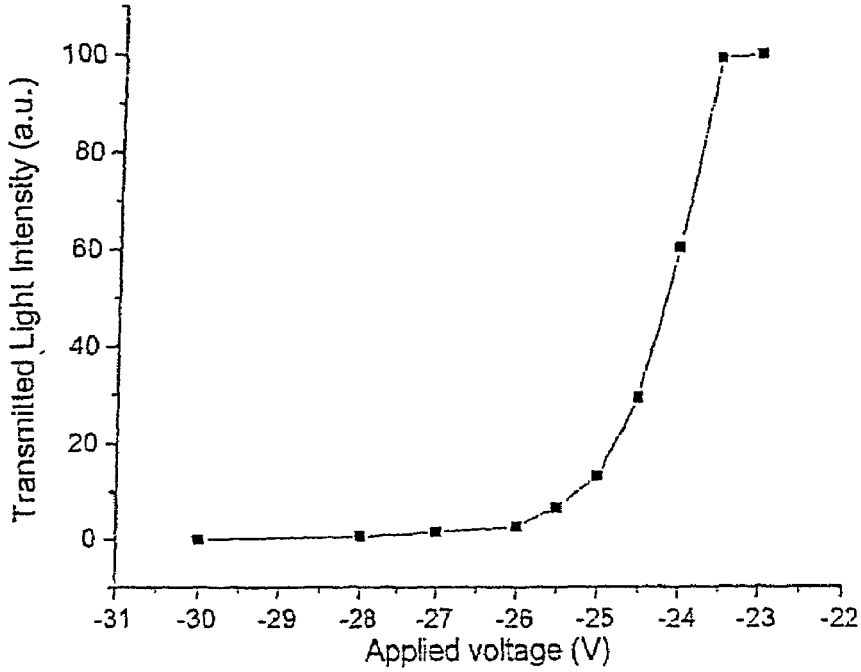
Figure 37:
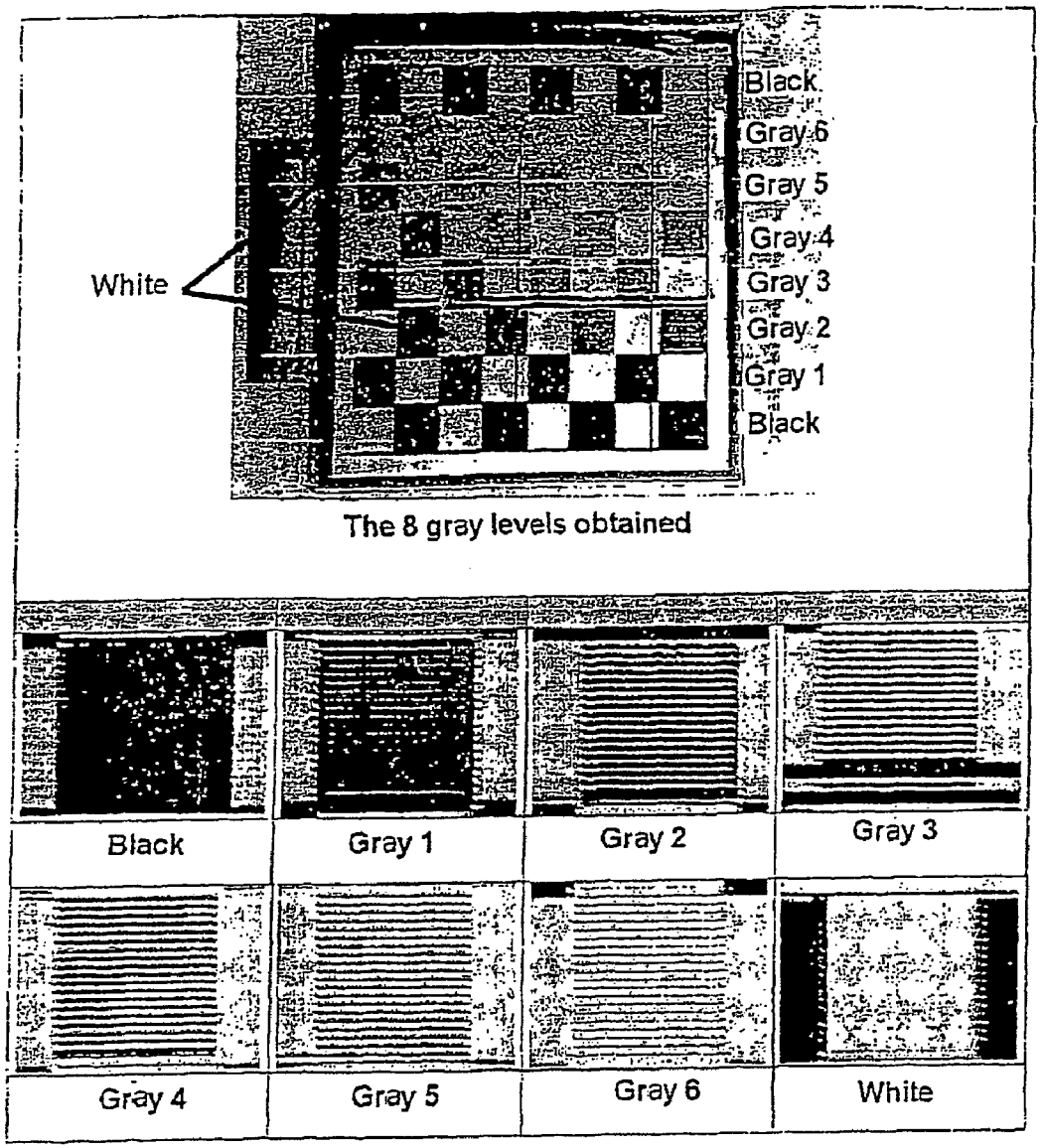
Figure 39:
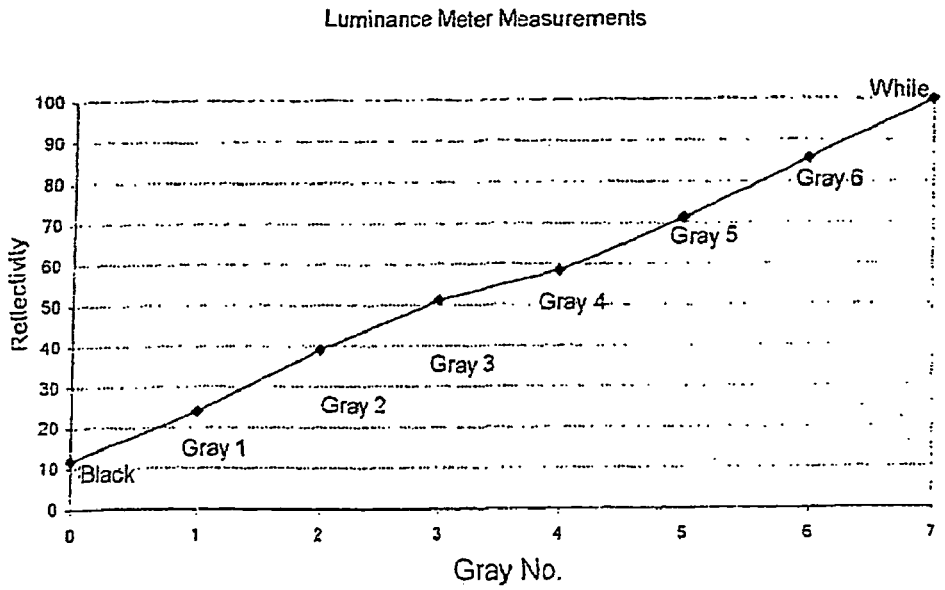
Figure 40:
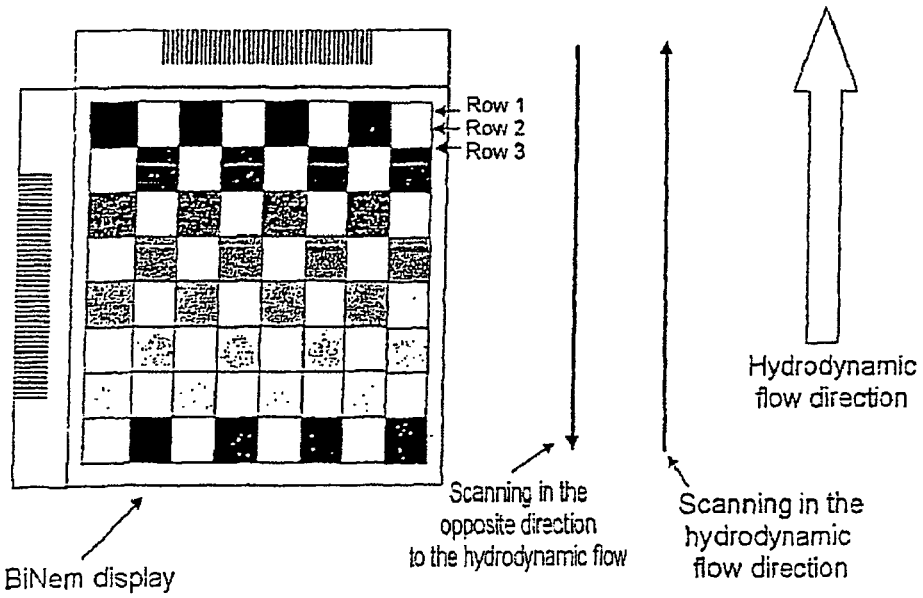
Figure 41:
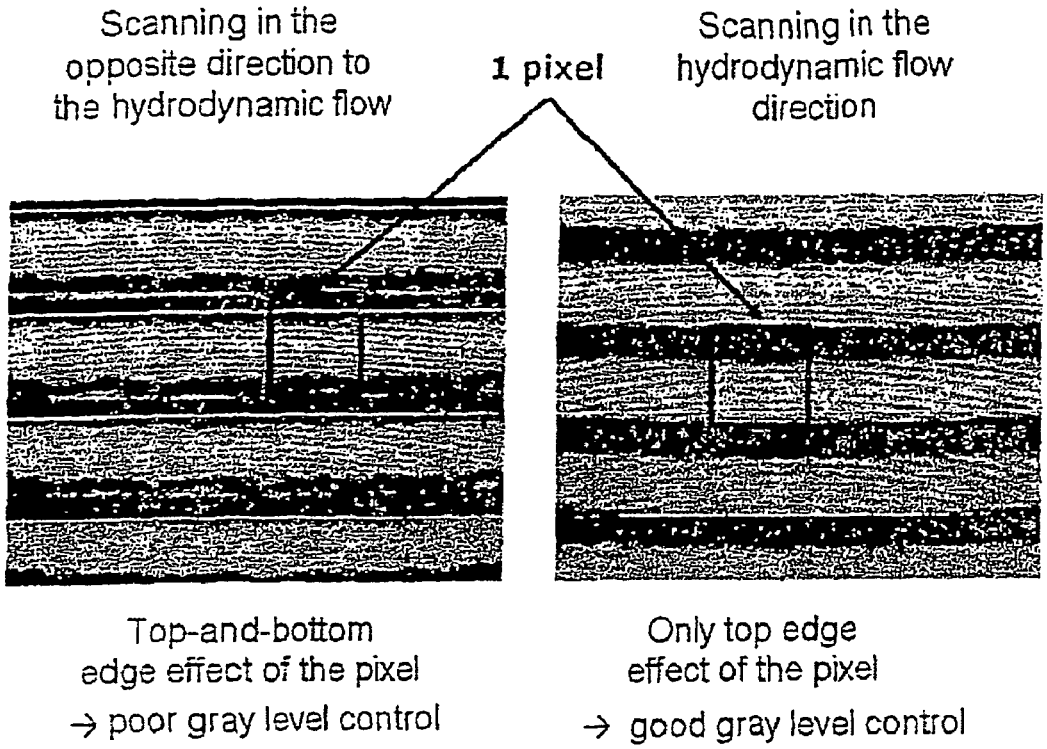

FIG. 20 shows, in the form of an electrooptic response curve, the percentage of T texture of a display as a function of the voltage $V_2$ illustrated in FIG. 4;

FIG. 21 shows six optical states of the pixels of a 160×480 display according to the prior art that are obtained by applying successive column voltages $V_c$ of −0.4 V, −0.8 V, −1 V, −1.4 V, −1.6 V, −2 V;

FIG. 22 shows four optical states of the pixels of a 160×480 display according to the prior art that are obtained by applying column pulses of variable durations, namely 100 μs, 200 μs, 300 μs and 500 μs respectively;

FIG. 23 shows the column signal parameters that can be modulated in order to produce gray levels by a "curtain effect" according to the invention; more precisely in FIG. 23, the first line shows a row signal n, the second line shows a row signal n+1, the third line labelled "a" indicates the modulation of the amplitude $V_c$ of the column signal, the fourth line labelled "b" indicates the modulation of the duration $T_c$ of the column signal and the fifth line labelled "c" indicates the modulation of the phase, characterized by $\Delta T_C$, of the column signal;

FIG. 24 shows the principle of producing the gray levels according to the invention;

FIG. 25 shows eight optical states of the pixels of a 160×480 display according to the present invention that are obtained by applying successive column voltages $V_c$ of −3.6 V, −2.8 V, −1.8 V, −0.8 V, −0.6 V, −0.5 V, −0.4 V and −0.2 V with the signals defined in Table III;

FIG. 26 shows the optical response curve of a display according to the present invention as a function of the column voltage $V_c$ for a temperature of 26.4° C.;

FIG. 27 shows eight optical states of the pixels of a 160×480 display according to the present invention that are obtained by applying column pulses of variable durations, namely 400 μs, 600 μs, 650 μs, 700 μs, 750 μs, 800 μs, 850 μs and 900 μs respectively;

FIG. 28 shows the optical response curve of a display according to the present invention as a function of the duration of the column pulse for an ambient temperature of 26.4° C.;

FIG. 29 shows six optical states of the pixels of a 160×480 display according to the present invention brushed at 60° to the direction of the row electrodes as a function of the column voltage $V_c$ for six voltages, namely −1.2 V, −2.8 V, −2.9 V, −3.1 V, −3.2 V and −3.4 V respectively;

FIG. 30 shows an example of row signals for a BiNem display addressed by a two-step method according to the invention; more precisely, FIG. 30 illustrates the example of a signal $V_{simul}$ of the one-stage "T transition" type and of two-stage multiplexing signals;

FIG. 31 shows an example of row signals for a BiNem display addressed by a two-step method according to the invention; more precisely, FIG. 31 illustrates the example of a signal $V_{simul}$ of the two-stage "U transition" type and of two-stage multiplexing signals;

FIG. 32 shows an example of row signals for a BiNem display addressed by a two-step method according to the invention; more precisely, FIG. 32 illustrates the example of a signal $V_{simul}$ of the one-stage "T transition" type and of one-stage multiplexing signals;

FIG. 33 shows an example of row signals for a BiNem display addressed by a two-step method according to the invention; more precisely, FIG. 33 illustrates the example of a signal $V_{simul}$ of the ramped "U transition" type and of one-stage multiplexing signals;

FIG. 34 shows a 4×4 pixel BiNem display driven using row signals according to FIG. 33; in this FIG. 34, the U texture represents the on (light) state whereas the T texture represents the off (dark) state;

FIG. 35 shows the optical response curve as a function of the voltage of the signal applied to the pixel for control signals of the type illustrated in FIG. 33;

FIG. 36 shows various ways of obtaining gray levels by the "curtain effect" in multiframe mode;

FIG. 37 shows a 160×160 BiNem display with a chequer board in which, in each row, there is an alternation of a white square and a square whose tone corresponds to a gray level, and also the zoom on the squares corresponding to the eight levels written;

FIG. 38 shows an enlargement of a few pixels of the display of FIG. 37;

FIG. 39 shows the optical response associated with each gray level of FIG. 37;

FIG. 40 illustrates two possible scanning directions for a 90°-brushed BiNem display, namely one in the same direction as the hydrodynamic flow and the other in the opposite direction to the hydrodynamic flow; and FIG. 41 shows the influence of the direction in which the display is scanned on the formation of the edge effects allowing gray levels or the "curtain effect" to be obtained.

The invention will now be explained in greater detail with regard to FIG. 13 et seq.

In the case of a BiNem as described above, the means for preventing two elements contiguous in the material flow direction from switching simultaneously is to differentiate the direction of the liquid-crystal molecules (which defines the flow direction) from the direction of the row electrodes of the display (which defines the pixels which will switch simultaneously).

Various prototypes of BiNem displays according to the invention characterized by a brushing direction markedly different from the direction of the row electrodes have been produced.

BiNem Display Brushed at 90° to the Direction of the Row Electrodes

Figure 3:
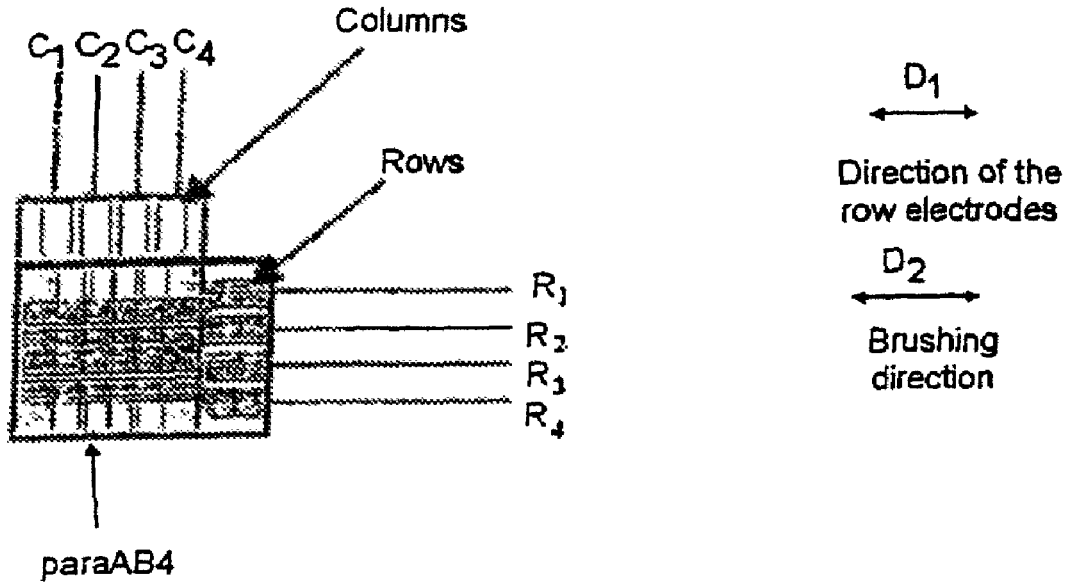
FIG. 3 shows schematically a 4-row×4-column BiNem display according to the prior art and illustrates in particular the direction $D_1$ of the row electrodes and the parallel direction $D_2$ of brushing.

A 4-row×4-column display similar to that of the first embodiment (illustrated in FIG. 3) was manufactured using what is called the BiNem general technology. The angle between the brushing direction $D_2$ and the direction of the row electrodes $D_1$ was set at 90°. This display is illustrated in FIG. 13. The brushing directions for the master plate and for the slave plate are identical.

This novel type of BiNem display is called an "orthogonal BiNem display". The AB4 display produced according to the invention is labelled orthoAB4 in FIG. 13.

The orthoAB4 display was then connected to the same drive electronics DE as that for the first experimental device. It was then addressed in multiplexed mode.

Observation of the Images in Multiplexed Mode

When the display was placed in the same optical device as previously, the same three images were observed after addressing.

This time, the appearance of edge defects on all the T pixels (see FIG. 14) was observed.

FIG. 14*a*, which corresponds to sixteen T pixels, was obtained with $V_{1R}$=15 V, $V_{2R}$=11 V and $V_C$=−3 V.

FIG. 14*b*, which corresponds to sixteen U pixels, was obtained with $V_{1R}$=15 V, $V_{2R}$=11 V and $V_C$=+3 V.

FIG. 14*c*, which corresponds to eight U pixels and eight T pixels was obtained with $V_{1R}$=15 V, $V_{2R}$=11 V and $V_C$=±3 V.

Analysis of the Switching Defects in Multiplexed Mode

The edge defects consisted of a parasitic U texture, extending over a typical length of 0.1 mm on either side of the edges in the brushing direction (now the top and bottom relative to the direction of the rows), of all the T pixels (see FIG. 15). The U pixels were unaffected.

The fact that the edge effect affects all the T pixels independently of the switching of the neighbouring pixels is an advantage over the prior art, as a uniform and controlled visual appearance is obtained. Moreover, decorrelating the edge effect from the row signal opens up the possibility during gray reduction of controlling the proportion of U and T identically on all the pixels.

BiNem Display Brushed at 45° to the Direction of the Row Electrodes

In this embodiment, a 45° angle was introduced between the brushing direction $D_2$ and the direction $D_1$ of the row electrodes. This device is shown schematically in FIG. 16.

The display was then connected to the same drive electronics DE as that for the initial device, with addressing in multiplexed mode.

Observation of the Images in Multiplexed Mode

Figure 17:
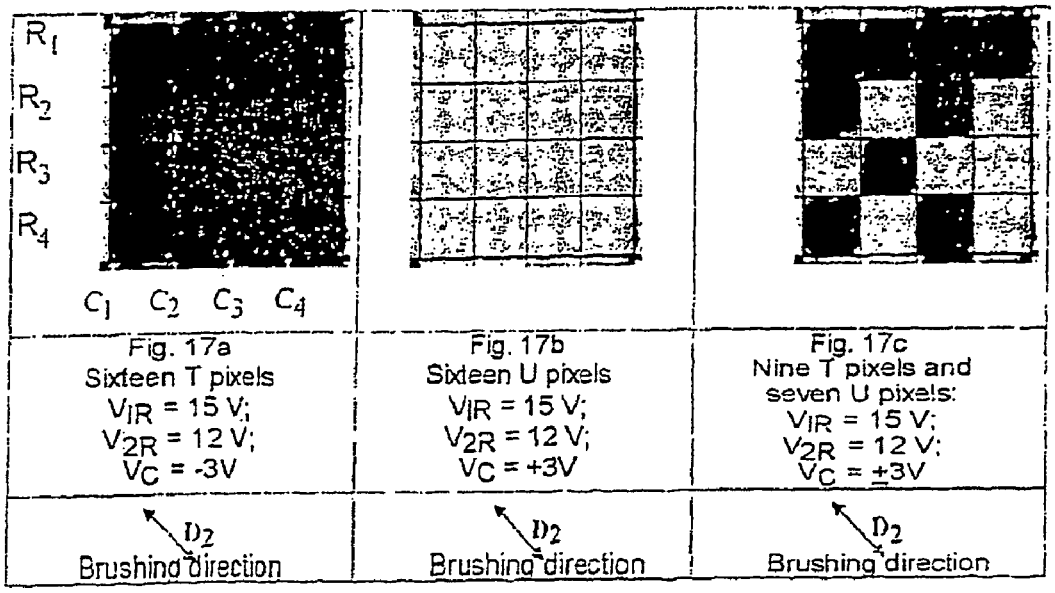

The images obtained in a similar manner are given in FIG. 17. A large reduction in the edge defects is observed.

FIG. 17*a*, which corresponds to sixteen T pixels, was obtained with $V_{1R}$=15 V, $V_{2R}$=12 V and $V_C$=−3 V.

FIG. 17*b*, which corresponds to sixteen U pixels, was obtained with $V_{1R}$=15 V, $V_{2R}$=12 V and $V_C$=+3 V.

FIG. 17*c*, which corresponds to nine T pixels and seven U pixels, was obtained with $V_{1R}$=15 V, $V_{2R}$=12 V and $V_C$=±3 V.

Analysis of the Switching Defects in Multiplexed Mode

The edge defects affected the two corners aligned along the brushing direction of all the T-addressed pixels (FIG. 18).

The defects consisted of a parasitic U texture with a typical diameter of less than 0.1 mm. The area of these defects was very much less than that observed in the initial device.

Geometric Advantage of the Invention

The fact of having shifted the edge effect, for example into the "top-bottom" direction relative to the rows rather than in the "left-right" direction of the prior art makes it possible to minimize this edge effect when the pixels of the display have their largest dimension in the "top-bottom" direction, as is the case for colour displays.

The principle of this geometric advantage is illustrated in FIG. 19 for a white square pixel with sides of 290 μm, subdivided into three subpixels (R, G, B). The edge effect is, assumed for the example to be about 30 μm along each edge.

For a display according to the prior art, called a "parallel" display, as soon as the edge effect becomes greater than one half the width of the pixel, the parasitic U texture, denoted here in black, invades the entire pixel (FIG. 19*a*)—transition to the T state of the pixel then becomes impossible.

For a display according to the invention called an "orthogonal" display, the parasitic U texture (shown in black) remains very minor in proportion compared with the T texture, which texture can therefore be obtained over a very large part of the pixel (FIG. 19*b*).

Advantage of Choosing the Operations Point

An electrooptic reference curve may be defined for the BiNem displays, namely the optical state or percentage of T texture as a function of the voltage $V_2$ as shown in FIG. 4 (Document [3]). This reference curve illustrated in FIG. 20 provides information about the parameters to be used for multiplexing the display.

This curve indicates that a BiNem display can be multiplexed either on the "left" operating point (the voltage $V_2$ of the row multiplexing signal is assigned the value $V_2$(L)) or the "right" operating point (row voltage $V_2$(R)).

A person skilled in the art will in fact know that, by varying the voltage $V_2$ on one side or the other of these two operating points $V_2$(L) and $V_2$(R) respectively, the percentage of T texture varies rapidly between 100% and 0%, and 0% and 100% respectively.

The "left" operating point is always preferable in theory, as it improves the display uniformity (improvement in the slope and reduction in the threshold voltage dispersion) and reduces screen flicker (by reducing the column voltages), and also allows one of the row voltages to be reduced. Unfortunately, it cannot in general be exploited in practice on conventional BiNem displays.

Experiments have shown that in orthogonal BiNem displays this operating point can be fully utilized, which means that they can benefit from the improvements indicated.

Advantage of Controlling the Gray Levels

It has been found experimentally that the invention furthermore makes it possible to switch the pixels in a well-controlled manner with gray levels on BiNem displays brushed at an angle to the direction of the row electrodes, for example brushed at 90° or 60° to this direction.

Production of Gray Levels According to the Prior Art

Document [8] describes one method of producing gray levels by modulating the voltage applied to the pixel, the proportion of U and T within the same pixel being controlled, according to the state of the art prior to the present invention. It has been found experimentally that by "parallel" addressing, the pixels placed in an intermediate optical state exhibit a multitude of contiguous U and T microdomains.

The photographs in FIGS. 21 and 22 show the variation in these microdomains with the drive voltage for a 160×480 BiNem display according to the prior art (with "parallel" brushing). FIG. 21 corresponds to the case in which the value of the column voltage varies while FIG. 22 corresponds to the case in which the duration of the column voltage varies. The addressing signals used were typically three-stage signals, as indicated in the diagram shown in FIG. 6. The values corresponding to the photographs in FIGS. 21 and 22 are given in Tables I and II, respectively.

TABLE I

| Pixel signal parameters (FIG. 21) | | |
|---|---|---|
| $V_{1R}$: 18 V | $V_{2R}$: 11.2 V | $V_C$: −0.4 to −2 V |
| $T_1$: 1 ms | $T_2$: 1 ms | $T_C$: 1 ms |

TABLE II

| Pixel signal parameters (FIG. 22) | | |
|---|---|---|
| $V_{1R}$: 18 V | $V_{2R}$: 8.6 V | $V_C$: −3 V |
| $T_1$: 1 ms | $T_2$: 1 ms | $T_C$: 100 to 500 μs |

The photographs in FIGS. 21 and 22 show that, for a given pixel, although the mean proportion of T texture increases when $V_C$ decreases, the centres of T texture microdomains remain randomly disposed within the pixel. The presence of a large number of small microdomains is not favourable to long-term stability of the gray state obtained.

Production of Gray Levels According to the Invention

In contrast, in the case of orthogonal addressing according to the present invention, the pixel consists of two domains, namely a T domain and a U domain that are separated by a straight wall. The large size of the domains gives optimum stability. This boundary moves in the pixel and thus determines a set of gray levels. This is obtained by controlling the hydrodynamic flow within a pixel using applied signals. This method of producing gray levels according to the invention, by controlling the hydrodynamic effect, we will call "curtain effect". In certain cases, the effect may propagate from the two opposed sides, rather than from just one.

This phenomenon is unique in the field of liquid-crystal displays. This is because the known liquid-crystal effects give a texture that is homogeneous on the scale of a pixel, at least as long as the structure of the cell and of the pixel is homogeneous and uniform by construction, something which is the case for the BiNem displays described in the present document.

The phenomenon described within the context of the present invention is, in this regard, very different from the gray levels obtained by filling the pixel with microscopic textures as described by Document [5]. This is because, in the latter method, an intentional dispersion is introduced, which acts on the characteristics of one of the structural elements of the pixel or the display.

In the present invention, the pixel is divided approximately into two regions, each region being occupied by one of the two textures. The length of the disclination lines or walls that separate the textures is therefore never microscopic. This situation is propitious for obtaining excellent stability of the extension of the textures, and therefore of the optical state of the pixel.

The gray levels of the display that are produced by "curtain effect" according to the invention can be controlled by modulating the various control parameters of the display.

These parameters are (see FIG. 23):

row parameters: $V_{1R}$, $V_{2R}$ (amplitude of the applied voltages) and $T_1$, $T_2$ (duration of the applied voltages);

time between two row signals $T_R$;

column parameters:

amplitude $V_C$ (FIG. 23*a*), duration $T_C$ (FIG. 23*b*) and phase $\Delta T_C$: the phase of the column signal is defined in FIG. 23*c* by the shift between the trailing edge of the second stage of the row signal and the trailing edge of the column signal. The value of $\Delta T_C$ may be positive or negative.

The parameter $T_R$ (the time that separates two row signals) is not necessarily variable, but it must be optimized.

According to a variant of the invention, the row signal comprises only one stage of value $V_R$. According to this variant in which the row signal is a one-stage signal, $V_R$ may be greater than or less than the anchoring-breaking threshold voltage.

According to a preferred embodiment in which the image is obtained in a single frame, only the column signal is then varied, by modulating the value $V_C$ of the column signal and/or the duration $T_C$ of the column signal and/or the phase $\Delta T_C$ of the column signal.

The principle of producing gray levels according to the invention for a pixel signal comprising two stages (in the particular case with $T_2=T_C$) is given in FIG. 24. In this example, the pixel signal is characterized by four parameters, namely $V_1$, $V_2$ (amplitude of the applied voltages) and $T_1$ and $T_2$ (duration of these applied voltages).

In multiframe multiplexed mode, the modulation of all the pixel signal parameters is acted upon by modulating some of these signals frame by frame.

Prototypes have been produced so as to test the control of gray levels by "curtain effect" in single-frame and multiframe mode.

Production of Gray Levels According to the Invention in Single-frame Mode

The gray levels were produced in the following three examples by modulating the column signal parameters, either the amplitude of the pulse or its duration.

Experimental Set-up with 160×480 BiNem Display Brushed at 90°

A BiNem display prototype with a definition of 160 rows× 480 columns, brushed at 90° to the direction of the row electrodes, was produced. This was therefore an orthogonal BiNem according to the nomenclature indicated above. The width of the column electrodes was about 0.085 mm, their length was about 55 mm and the insulation between columns was about 0.015 mm. The width of the rows was about 0.3 mm, their length about 55 mm and the insulation between rows was about 0.015 mm. The elementary pixel was that described in FIG. 19*b*. The brushing direction $D_2$ was perpendicular to the row electrodes. The display was provided with a rear reflector, a front polarizer and a front illumination device in order to operate in reflective mode, that is to say the T texture represented the on state (it appeared light) while the U texture represented the off state (it appeared dark). Suitable drive electronics, delivering 160 row signals and 480 column signals, completed the device and allowed the display to be addressed in multiplexed mode.

The pixels of the test vehicle were observed under magnification compatible with the observation of the textures present in the pixels.

The display was addressed by multiplexing signals, the default parameters thereof and the excursions thereof are defined in Table III.

The addressing signals were typically three-stage signals, the diagram of which is indicated in FIG. 6. The intermediate stage is at the voltage of the second row stage $V_2$. Its duration is the difference between the time $T_2$ of the second row stage and the time $T_C$ of the column pulse.

$T_R$ is the time between two row signals. It was optimized in order to obtain gray levels by curtain effect according to the invention.

For each value of the parameter or parameters selected (for example the column voltage $V_C$ or the duration of the column pulse $T_C$), a test image was addressed. Next, the textures obtained in a selected region of the display were observed.

Observation of the Pixels with Modulation of the Column Voltage $V_C$

The multiplexing voltage $V_C$ applied to the columns was continuously varied between 0 V and −3.6 V (the other parameters of the pixel voltage are given in Table III), while observing the optical state obtained for each voltage. The result is illustrated in FIG. 25.

TABLE III

| | | | |
|---|---|---|---|
| $V_{1R}$: 15 V | $V_{2R}$: 5.4 V | $V_C$: 0 to −4 V | |
| $T_1$: 950 μs | $T_2$: 300 μs | $T_C$: 250 μs | $T_R$: 60 μs |

According to a preferred embodiment, the pixels were previously set in a given state, for example the T state, before being addressed for the gray levels (see below).

FIG. 25 shows that, starting from pixels in the T texture, the proportion of U texture progressively increases, as if a blind were being progressively raised, hence the name "curtain effect".

Optical Response with Gray Levels by Modulating the Column Voltage

FIG. 25 demonstrates the excellent capability of the 90°-brushed BiNem display to reconstitute a scale of gray levels.

The optical response of the display as a function of the applied column voltage $V_C$ is illustrated in FIG. 26.

This continuous response lends itself particularly well to the production of multiplexed BiNem displays with gray levels by modulating the column voltages $V_C$.

Observation of the Pixels by Modulating the Duration of the Column Pulses

The duration of the column pulses varied from 400 μs to 900 μs.

The other parameters of the multiplexing signals are indicated in Table IV. $T_R$ is the time between two row signals. It was optimized for obtaining the gray levels

TABLE IV

| | | | |
|---|---|---|---|
| $V_{1R}$: 15 V | $V_{2R}$: 6 V | $V_C$: −3 V | |
| $T_1$: 950 μs | $T_2$: 950 μs | $T_C$: 200 to 900 μs | $T_R$: 60 μs |

Optical Response with Gray Levels by Modulating the Column Duration

Here again, a scale of gray levels is obtained: the filling of the pixel with the T (or U) texture is continuously varied between 0 and 100%, this proportion being able to be controlled by the duration of the applied column pulses, as shown in FIG. 27.

The optical response curve of the display as a function of the duration of the applied column pulses is shown in FIG. 28.

This continuous response allows multiplexed BiNem displays to be produced with gray levels by modulating the duration of the column signals.

The parameters used for the multiplexing signals are given in Table IV above.

Experimental Set-up with a 60°-brushed 160×480 BiNem Display and Results

The test vehicle was the same as that previously, with the difference that the brushing direction is now 60° instead of 90°.

Gray levels are again able to be obtained with such a display, as the following observations show.

The multiplexing voltage applied to the columns was continuously varied between −1.2 V and −3.4 V, while observing the optical state obtained for each voltage. The result is shown in FIG. 29.

The parameters used by default for the multiplexing signals are given in Table V below. $T_R$ is the time between two row signals. It was optimized to obtain gray levels by curtain effect according to the invention.

TABLE V

| | | | |
|---|---|---|---|
| $V_{1R}$: 15 V | $V_{2R}$: 6.2 V | $V_C$: −3 V | |
| $T_1$: 950 μs | $T_2$: 450 μs | $T_C$: 250 μs | $T_R$: 60 μs |

The time $T_R$ between rows, in this case equal to 60 μs, may be extended so as to reduce the rms voltage present at the terminals of the liquid crystal. Typically, it can range up to about 20 ms, above which the time for addressing the entire display becomes too long.

A Variant: Two-step Addressing

It will be recalled that the liquid-crystal cell parameters, the voltages and the addressing mode, and the operating temperature are as many factors that can influence the switching of a BiNem cell. Depending on the value of these factors, there may exist a texture that is "easy" to obtain and a texture that is "difficult" to obtain, or else a "rapid" texture that is rapidly obtained and a "slow" texture that is slowly obtained. For example, this is particularly true as regards the temperature factor, which has a notorious effect on the properties of liquid crystals and therefore on the switching characteristics.

Moreover, the switching of a BiNem cell into the T state involves the displacement of the liquid crystal in the alignment direction of the molecules. This switching is performed more easily when the area that has to be switched is larger. Thus, simultaneous switching of several rows at a time (called "packet" switching) or indeed switching of the entire display (called "collective" switching) is easier than switching row by row.

As regards switching to the U state, this is performed more slowly than switching to the T state and requires several voltage plateaux or a voltage ramp. It may therefore be advantageous to perform this switching simultaneously on several rows at a time ("packet" switching) or even on the entire display ("collective" switching).

The combination of these two observations has led to the advocation of addressing a BiNem display in two steps:

- a "simultaneous" first step, in which the pixels of the display are packet-switched or collectively switched into the "difficult" or "slow" texture; and
- a second step in which the entire display is addressed in multiplexed mode so as to switch the pixels of the display that have to adopt the "easy" or "rapid" state.

An example of the implementation of two-step addressing according to the invention is illustrated in FIG. 30, taking the example of a collective signal of the type for setting the display in the T state. Two rows, n and n+1, are considered in this non-limiting example, but the principle can be generalized to the entire display. The parameters of the row signal $V_{simul}$ applied simultaneously to several rows ($V_{sT}$, $\tau'_p$) are adapted to the collective mode of switching and may vary with certain parameters. Here; $V_{simul}$ has only one stage, but it may also comprise two or more thereof. The multiplexing signal parameters ($V'_{R1}$; $V'_{R2}$; $T'_1$; $T'_2$; $V'_C$; $T'_C$) are also adapted and may adopt values different from those used in the simple multiplexed mode. The row signals, in this example two-stage signals, may also be multistage or single-stage signals. The column signals may be amplitude-modulated, time-modulated or phase-modulated as illustrated in FIG. 23, or a combination of two or even three methods.

Another example of the implementation of two-step addressing according to the invention is illustrated in FIG. 31, taking the example of a collective signal of the type for setting in the U state. Two rows, n and n+1, are involved in this non-limiting example, but the principle can be generalized to the entire display. The parameters of the row signal $V_{simul}$ applied simultaneously to several rows ($V_{SU1}$; $V_{SU2}$; $\tau''_p$) are adapted to the collective mode of switching and may vary with certain parameters. The multiplexing signal parameters ($V''_{R1}$; $V''_{R2}$; $T''_1$; $T''_2$; $V''_C$; $T''_C$) are also adapted and may adopt values different from those used in the simple multiplexed mode. The row signals, which in this example are two-stage signals, may also be multistage or single-stage signals. The column signals may be amplitude-modulated, time-modulated or phase-modulated as illustrated in FIG. 23, or a combination of two or even three methods.

Another example of the implementation of two-step addressing according to the invention is illustrated in FIGS. 32 and 33, in which the multiplexing signals are single-stage signals. The column signals may be amplitude-modulated, time-modulated or phase-modulated as illustrated in FIG. 23 or a combination of two or even three methods. In FIG. 32, the signal $V_{simul}$ for setting into the U state is in the form of a ramp.

The simultaneous switching as regards the difficult texture may take place by the "packet switching" of the p rows, which are then addressed in multiplexed mode, and then the packet of the next p rows is addressed collectively and then multiplexed, and so on until all the rows of the display have been addressed.

The simultaneous switching as regards the difficult texture may also be accomplished collectively for all of the rows of the display, and then the latter is addressed in multiplexed mode on all these rows, as is usually carried out.

A first example of two-step addressing as illustrated in FIG. 30 is:

First Step:

Simultaneous collective-type signal (all the rows of the display at the same time) with the following parameters (Table VI):

TABLE VI

| $V_{ST}$ | $\tau_P'$ |
|---|---|
| 25 V | 5 ms |

Second Step:

Modulation of $V_C$: multiplexed-type addressing as described in Table VII so as to produce gray levels by "curtain effect" according to the invention.

TABLE VII

| $V_{R1}$: −20 V | $V_{R2}$: −7 V | $V_C$: 0 to −3 V | White: $V_C$ = +3 V |
|---|---|---|---|
| $T_1$: 1 ms | $T_2$: 1200 μs | $T_C$: 1200 μs | $T_R$: 100 μs |

In this example, the gray levels are obtained with the negative values of $V_C$, but the white is obtained with a positive value of $V_C$ of +3 V.

A first example of two-step addressing as illustrated in FIG. 32 is:

First Step:

Simultaneous collective-type signal (all the rows of the display at the same time) with the parameters of Table VI:

Second Step:

Modulation of $V_C$ and $T_C$: multiplexed-type addressing as described in Table VIII so as to produce gray levels by "curtain effect" according to the invention.

TABLE VIII

| $V_{R1}$: −20 V | $V_{R2}$: 0 V | $V_C$: −3 V to −5 V | |
|---|---|---|---|
| $T_1$: 1 ms | $T_2$: 0 ms | $T_C$: 0 to 800 μs | $T_R$: 50 μs |

A second example of two-step addressing as illustrated in FIG. 32 is:

First Step:

Simultaneous collective-type signal (all the rows of the display at the same time) with the parameters of Table VI:

Second Step:

Modulation of $\Delta T_C$: multiplexed-type addressing as described in Table IX so as to produce gray levels by "curtain effect" according to the invention.

TABLE IX

| $V_{R1}$: −20 V | $V_{R2}$: 0 V | $V_C$: −5 V | $\Delta T_C$: 0 to 400 μs |
|---|---|---|---|
| $T_1$: 1 ms | $T_2$: 0 ms | $T_C$: 600 μs | $T_R$: 50 μs |

An example of two-step addressing as illustrated in FIG. 33 is that corresponding to Table X.

TABLE X

| $V_{SU}$ | $\tau''_p$ | $V''_R$ | T'' | $T_R$ | $V_c$ |
|---|---|---|---|---|---|
| −20 V | 1 ms | −23.5 V | 50 μs | 10 ms | 0 to 4 V |

In this case, the single-stage row signal in multiplexed mode is very short (50 μs) and the time between rows is rather long (10 ms).

An example of the textures obtained is given in FIG. 34. The white first row is 100% U ($V_C$=0 V), the black fourth row is 100% T ($V_C$=3 V) and the two intermediate rows correspond to two gray levels, namely gray 1 ($V_C$=0.4 V) and gray 2 ($V_C$=1 V). It may be seen that this mode of addressing makes it possible to obtain a "curtain effect" according to the invention. FIG. 35 shows the optical transmission as a function of the pixel voltage, equal to $V''_R - V_C$. Modulation between black and white is obtained with a 4 V variation in $V_C$.

The signal $V_{simul}$ may be a positive monopolar signal, a negative monopolar signal or a bipolar signal, which is not necessarily symmetrical. The important point is not its precise waveform but its function, which is to switch, collectively or in packets, rows of the display so as to set them in a state (liquid-crystal texture) that is perfectly defined before the multiplexing signals are applied.

The time between row signals $T_R$ is a factor that can be optimized as a function of the other addressing parameters.

Production of Gray Levels According to the Invention in Multiframe Mode

Experimental Set-up with a 90°-Brushed 160×160 BiNem Display

This mode is for example beneficial when it is not possible to modulate $V_C$ directly, as is the case when STN drivers are used.

A BiNem display of the same type as previously, but comprising 160×160 square pixels was used for this experiment. The size of an elementary pixel was 290 μm.

General Principle of the Multiframe Addressing Method

To produce gray levels, the value of all the addressing signals may be modified between two frames. To obtain n gray levels, typically n frames must be addressed.

Let $V_{R1}(i)$, $T_1(i)$, $V_{R2}(i)$, $T_2(i)$, $V_C(i)$ and $T_C(i)$ be the row and column signals associated with the frame i. The inter-row time $T_{1R}$ is also a parameter to take into account. All these values may theoretically be modified between two frames so as to generate the desired gray levels.

According to a preferred embodiment, the pixels are preset in a given state, before being addressed for the gray levels.

The variant of "two-step" addressing may be applied—frame 1 then corresponds to the "simultaneous" first step, in which the pixels of the display are switched in packets or collectively into the "difficult" or "slow" texture. The following frames are addressed in multiplexed mode.

Example When an STN Driver is Used for the Columns

In this case, only the 0 V and fixed $\pm V_C$ values are accessible. The row parameters will therefore be changed between two frames in order to obtain the gray levels. For example, the approach may be the following in the case of a row m:

Frame 1: all the pixels are switched to 100% T;

Frame 2: all the pixels of the row that have to be 100% U are switched into the U state (for example with a column signal $-V_C$). The other pixels receive an inoperative signal, and therefore remain 100% T;

Frame 3: next, the pixels that have to have a slightly lower proportion of U, for example 80%, are addressed. The pixels on hold to be addressed as gray levels, that is to say "on hold for being filled", receive an inoperative signal, which confirms their T state. The "already filled" pixels with the correct proportion of U (in this case, those in 100% U) also receive an inoperative signal; and Frame 4: next, the pixels that have a low proportion of U, for example 60%, are addressed. The pixels "on hold to be filled" receive an inoperative signal, which confirms their T state. The pixels "already filled" with the correct proportion of U (in this case, those in 100% U and 80% U) also receive an inoperative signal.

And so on from frame to frame until the pixels that have the lowest percentage of U before 0% have been addressed.

With n frames, there will be (n−2) gray levels plus white and black.

An illustration of this mode of addressing is given in FIG. 36 for three gray levels plus black and white, i.e. five frames. In this example, the column voltage may take the values 0, $+V_C$ and $-V_C$, the duration $T_C$ is fixed and the parameters $V_{R1}$, $V_{R2}$, $T_1$, $T_2$ are varied in each frame in order to obtain the desired gray level. The row voltages are negative in this example.

The operating mode is as follows:

Frame 1: firstly, all the pixels are collectively switched to the T state. For a given frame i:

- the pixel that will be addressed in the corresponding gray level will have $-V_C$ on their column and adapted values of $V_{R1}(i)$, $V_{R2}(i)$, $T_1(i)$, $T_2(i)$;
- the pixels "on hold to be filled" that are not involved in the state corresponding to the frame are addressed with an inoperative signal that confirms their 100% T state. This inoperative signal is, for example, a signal possessing, of course, the same row parameters $V_{R1}(i)$, $V_{R2}(i)$, $T_1(i)$, $T_2(i)$ and a value of $+V_C$ on their column; and
- the pixels "already filled" in the U state by the frames from 1 to i−1 must no longer be modified—they receive an inoperative signal. This signal has, in the example of FIG. 36, again a value of $+V_C$ on the column, with again, of course, the same row parameters $V_{R1}(i)$, $V_{R2}(i)$, $T_1(i)$ and $T_2(i)$. Another type of inoperative signal for the "already filled" pixels may be $-V_C$ (see the experimental illustrative example below). Here, for unexplained reasons, everything occurs as if once in the U state, the return to the T state is impossible, except in collective mode.

Experimental Implementation with the Test Vehicle

The addressing mode illustrated in FIG. 36 was applied to the 160×160 BiNem display in order to obtain six gray levels plus white and black, i.e. a total of eight frames. Table XI below gives, for each frame i, the values of the various voltages and durations applied:

- on the row for frame i: $V_{R1}(i)$, $V_{R2}(i)$, $T_1(i)$ and $T_2(i)$;
- on the column for the pixels that it is desired to set in the gray level associated with the frame: $-V_C$;
- on the column for the pixels "on hold to be filled": inoperative signal $+V_C$; and
- on the column for the "already filled" pixels: the inoperative signal $-V_C$.

Frame 1 is dedicated to collective 100% T (white) setting. Then, in multiplexed mode, the following frames "fill" the pixels with U.

Frame 2 is dedicated to setting the pixels whose final state is 100% U (black).

Frame 3 is dedicated to the pixels to be addressed in dark gray, etc. up to the lightest gray.

In this example, the gray levels are obtained firstly by varying the value of $V_{R2}$ and then in the case of the lighter gray levels, by reducing the duration $T_1$.

Of course, in this multiframe mode, many combinations are possible within the variations of the pixel voltage parameters.

TABLE XI

Example of the parameters for the voltage applied to the pixels in eight-frame mode

| | $V_{R1}$ (volts) | $T_1$ (ms) | $V_{R2}$ (volts) | $T_2$ (ms) | $T_C$ (ms) | Gray $V_C$ (volts) | "On hold" $V_C$ | "Already filled" $V_C$ |
|---|---|---|---|---|---|---|---|---|
| Frame 1 (100% T): White | −20 | 10 | 0 | 0 | 0 | 0 | 0 | 0 |
| Frame 2 (100% U): Black | −20 | 3 | −12 | 1.2 | 1.15 | −4 | +4 | — |
| Frame 3: dark gray 1 | −20 | 3 | −11 | 1.2 | 1.15 | −4 | +4 | −4 |
| Frame 4: gray 2 | −20 | 3 | −10.4 | 1.2 | 1.15 | −4 | +4 | −4 |
| Frame 5: gray 3 | −20 | 3 | −10 | 1.2 | 1.15 | −4 | +4 | −4 |
| Frame 6: gray 4 | −20 | 3 | −9.6 | 1.2 | 1.15 | −4 | +4 | −4 |
| Frame 7: gray 5 | −20 | 2 | −9.6 | 1.2 | 1.15 | −4 | +4 | −4 |
| Frame 8: light gray 6 | −20 | 1.2 | −9.6 | 1.2 | 1.15 | −4 | +4 | −4 |

FIG. 37 shows a 160×160 BiNem display, addressed in the mode described above, with a chequerboard in which each row alternates between a white square and a square whose tone corresponds to a gray level, and also the zoom on the squares corresponding to the eight levels written. Here again a very uniform control of the proportion of U and T in all the pixels may be seen. FIG. 38 shows an enlargement of a few pixels in order to make the effect more visible. The very straight character of the boundary between the two textures should be noted. FIG. 39 gives the optical response associated with each gray level.

Figure 1:
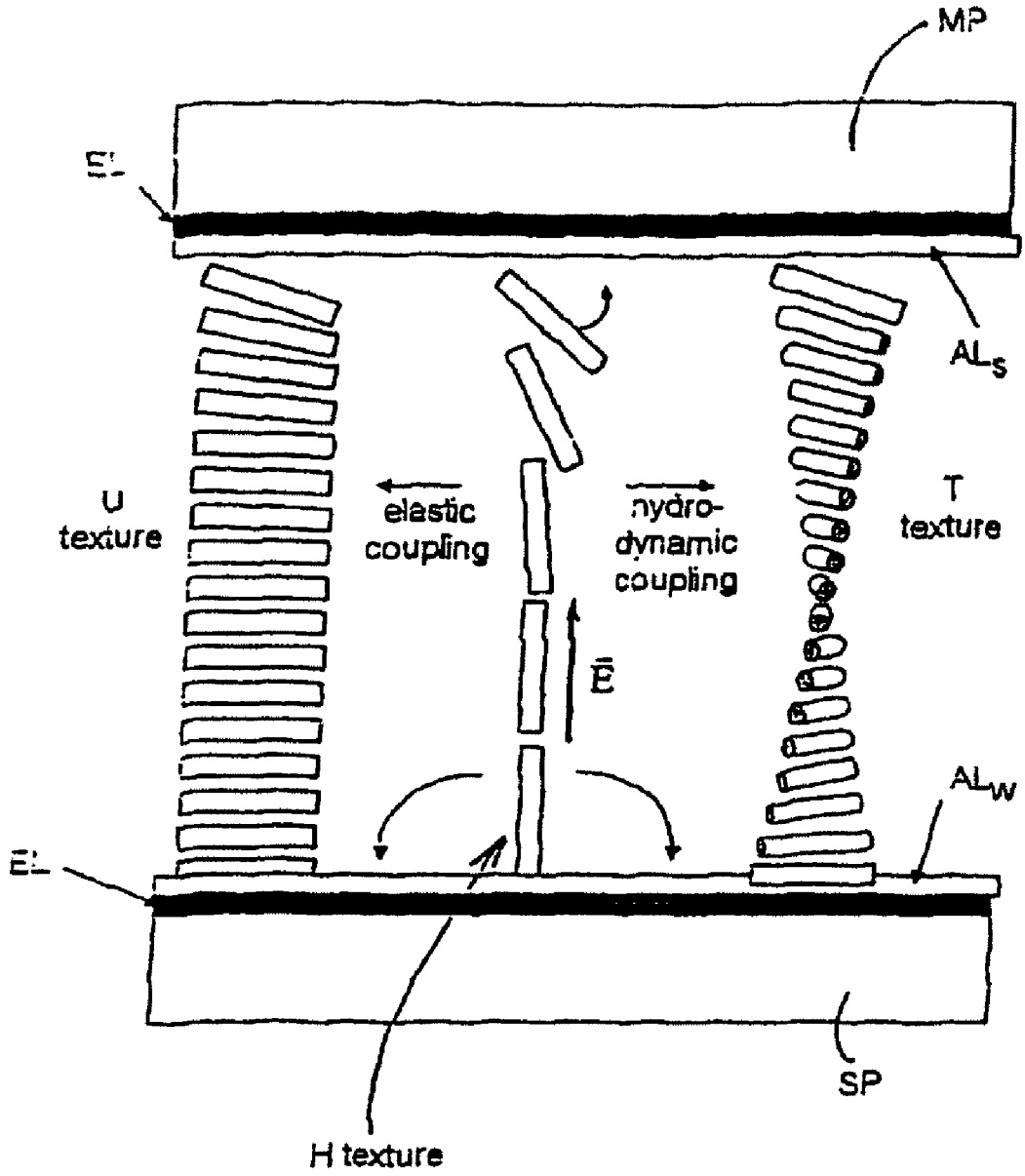
FIG. 1 illustrates schematically the principle of operation of a BiNem-type display.
Figure 2:
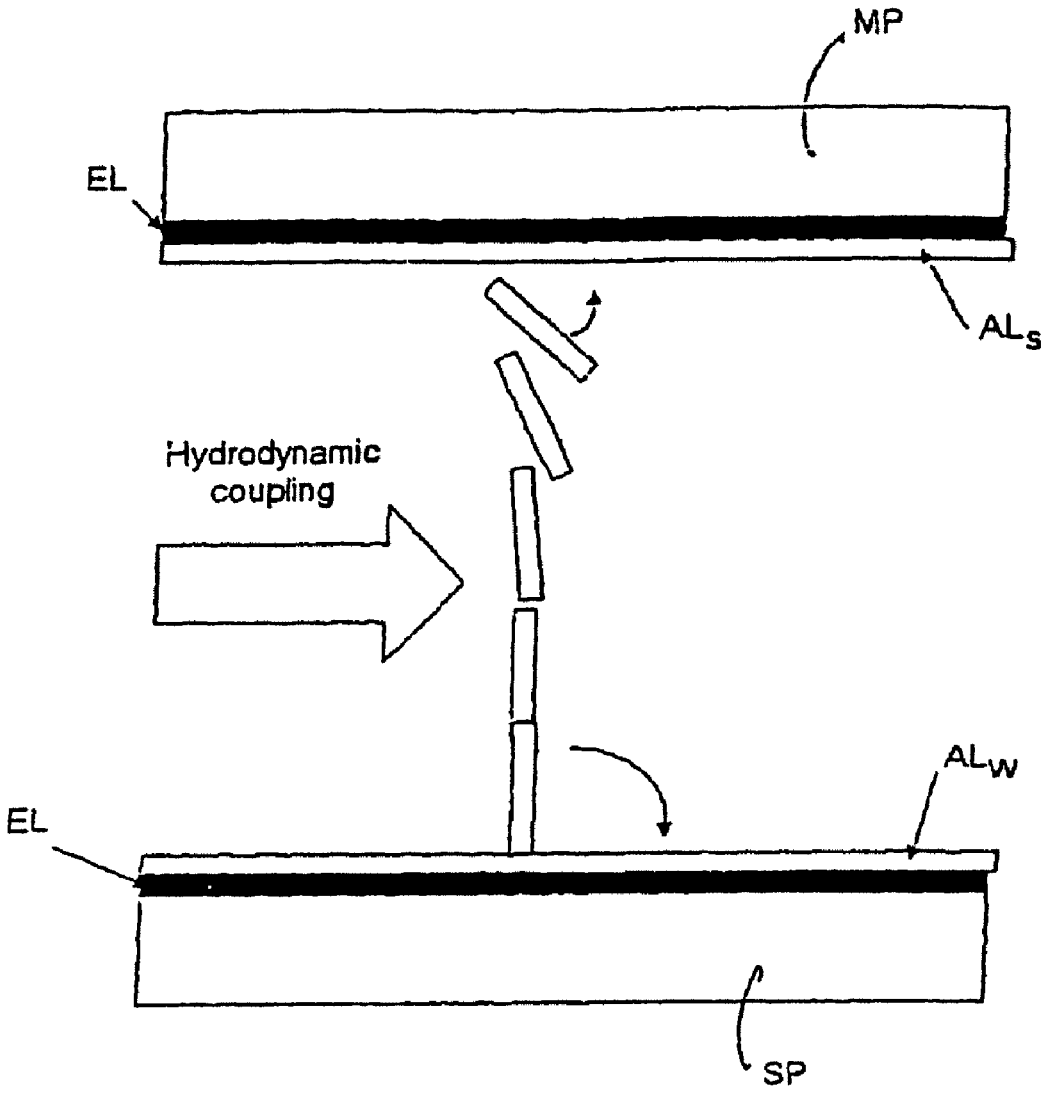
FIG. 2 shows the hydrodynamic flow present in the cell when the electric field is suddenly cut off.

In this example, it should also be noted that the "curtain effect" appears only along a single edge and not along both edges (FIG. 38). For these experiments, the scanning was carried out in the hydrodynamic flow direction (see FIGS. 2 and 40). This is because for a 90°-brushed BiNem display there are two possible scanning directions, namely one in the same direction as the hydrodynamic flow, and the other in the opposite direction to the hydrodynamic flow. If the scanning is carried out in the opposite direction to the flow, the "curtain effect" appears along both edges (FIG. 41) and the gray levels are more difficult to control, particularly the dark grays. There is therefore a preferred scanning direction for obtaining a single "curtain effect"—this preferred scanning direction is identical to the direction of the hydrodynamic flow.

Of course, the present invention is not limited to the particular embodiments that have just been described, rather it extends to any variant in accordance with its spirit.

In particular, the present invention could involve the application of the provisions taught in Document [3], namely in particular:

- a device for addressing a bistable nematic liquid-crystal matrix display with anchoring breaking, comprising means designed to apply, to the column electrodes of the display, an electrical signal whose parameters are adapted in order to reduce the rms voltage of the parasitic pixel pulses to a value below the Freederiksz voltage, so as to reduce the parasitic optical effects of the addressing;
- a device in which the end of the column signal is synchronized with the end of the row pulse;
- a device in which the duration of the column signal is less than the duration of the plateau of the row pulse;
- a device in which the duration of the column signal is of the order of one half of the duration of the last plateau of the row pulse;
- a device in which the column signal is in the form of a square wave;
- a device in which the column signal is in the form of a ramp;
- a device in which the column signal is in the form of a ramp which increases linearly until it reaches a maximum voltage, and then is suddenly dropped to zero in synchronism with the end of the row pulse;
- a device in which the electrical signals applied are adapted in order to define a zero mean value for the pixel signal;
- a device in which each row signal and each column signal comprises two successive subassemblies of identical configuration but of opposite polarities;
- a device in which the polarity of the row signals and of the column signals is reversed at each change of image;
- a device in which a common voltage is applied to the useful components of the row signals and of the column signals in such a way that the signals applied to each pixel have two successive subassemblies of opposite polarities; and
- a device of the active matrix type, using transistors deposited on glass, to control the switching of the pixels individually such as, for example, that described in Document [9].

The present invention may also involve the application of the provisions taught in Document [4], namely in particular:

- a device for electrically addressing a bistable nematic liquid-crystal matrix display with anchoring breaking, comprising means capable of applying controlled electrical signals to row electrodes and to column electrodes of the display, respectively, comprising means capable of simultaneously addressing several rows, using similar row signals that are temporarily offset by a delay greater than or equal to the time required to apply the column voltages, said row addressing signals comprising, in a first period, at least one voltage value for breaking the anchoring of all the pixels of the row, and then a second period for determining the final state of the pixels making up the addressed row, this final state depending on the value of each of the electrical signals applied to the corresponding column;

a device in which $\tau_c \leqq \tau_D < \tau_L$, in which relationship:

$\tau_D$ represents the time shift between two row signals, $\tau_L$ represents the row address time, comprising at least one anchoring-breaking phase and one texture selection phase and $\tau_c$ represents the duration of a column signal;

a device in which the time for addressing x simultaneously addressed rows is equal to $\tau_L+[\tau_D(x-1)]$, in which equation:

$\tau_D$ represents the time shift between two row signals and $\tau_L$ represents the row address time comprising at least one anchoring-breaking phase and one texture selection phase;

a device in which the simultaneously addressed rows in temporal overlap are adjacent rows;

a device in which the simultaneously addressed rows in temporal overlap are spatially spaced-apart rows;

a device in which means capable of simultaneously addressing the i modulo j rows, i.e. the rows i, i+j, i+2j, etc., by providing a row signal of duration $\tau_L=j\tau_D$, by time-shifting by $\tau_D$ two successive row signals applied simultaneously and by shifting by $\tau_L$ the successive blocks of row signals applied simultaneously;

a device in which x consecutive rows are addressed simultaneously with a time shift $\tau_D$ from one row to the other, the column signals corresponding to each row are sent sequentially every $\tau_D$, and each row signal has an overall duration at least equal to $\tau_L=x\tau_D$;

a device in which the start of the row signal for the (i+x)th row is synchronized to the end of the row signal of the ith row;

a device in which the row signals do not exhibit symmetrization;

a device in which the signals exhibit frame symmetrization;

a device in which the polarization of the row signals is reversed from an image p to the next image p+1;

a device in which the polarity of the row signals and the polarity of the column signals are reversed from an image p to the next image p+1;

a device in which the polarity of two successive row signals is reversed;

a device in which the polarity of two successive row signals, and of two successive column signals respectively, is reversed;

a device in which the number of rows addressed at a time is at least equal to $x_{opt}$=integer part of $[\tau_L/\tau_D]$, in which equation:

$\tau_D$ represents the time shift between two row signals and $\tau_L$ represents the row address time, comprising at least an anchoring-breaking phase and a texture selection phase;

a device in which the signals exhibit row symmetrization;

a device in which each row signal comprises two adjacent successive sequences exhibiting respectively opposite polarities;

a device in which the column signal is split into two sequences, the end of which is synchronized to the end of the first sequence and of the second sequence, respectively, of the associated row signal, the polarity of the two sequences of the column signal also being reversed;

a device in which the end of the column signal is synchronized to the end of the second sequence of the associated row signal;

a device in which the polarity of two successive row signals is reversed;

a device in which the polarity of two successive row signals, and of two successive column signals respectively, is reversed;

a device in which the number of rows addressed at a time is at least equal to $x_{opt}$=integer part of $[2\tau_L/\tau_D]$, in which equation:

$\tau_D$ represents the time shift between two row signals and $\tau_L$ represents the row address time comprising at least an anchoring-breaking phase and a texture selection phase; and a device in which the column signal is chosen from the group comprising: a column signal of duration less than or equal to the duration of the last plateau of the row signal; a column signal of duration $\tau_C$ equal to $\tau_D$; and a column signal of duration $\tau_C$ less than $\tau_D$, $\tau_D$ representing the time shift between two row signals, whereas $\tau_C$ represents the duration of the column signal.

The present invention may also apply, whether in particular for one-step addressing signals or two-step addressing signals, to arrangements taught in document [10], namely in particular:

a display device that includes addressing means capable of generating, and of applying to each of the pixels of the matrix display, control signals that have sloping rising edges, preferably sloping rising edges having a slope from 0.1 V/μs to 0.005 V/μs;

a device that includes addressing means suitable for generating signals having two phases: an anchoring-breaking first phase and a selection second phase;

a device whose addressing means are suitable for generating, in order to obtain a uniform texture, signals for which the drop between two successive stages of the trailing edge of the selection phase does not exceed a critical threshold value ΔV, whereas, to obtain a twisted texture, the trailing edge includes at least one sudden drop greater than the critical threshold value ΔV;

a device in which the rising edge has a duration $\tau_R$ of 200 μs to 4 ms;

a device in which the rising edge has a duration $\tau_R$ greater than 300 μs;

a device in which the addressing and control signals also include sloping trailing edges at the end of an anchoring-breaking phase;

a device in which the slope of the trailing edge is of the same order of magnitude as the rising edge; and a device in which each pixel is controlled by a component, for example a transistor, capable of being switched between two states, the on state and the off state respectively.

The present invention also extends to combinations of the aforementioned features.

Within the context of the present invention, the two textures that differ by about 180° are not necessarily in one case a uniform or slightly twisted (i.e. close to 0°) texture and the other close to a half-turn (i.e. close to 180°). This is because, within the context of the present invention, these two textures may be provided with different twists, for example 45° and 225°.

CITED DOCUMENTS

Doc [1]: FR 2 740 894
Doc [2]: C. Joubert, Proceedings SID 2002, pp. 30-33
Doc [3]: FR 2 835 644
Doc [4]: FR 2 838 858
Doc [5]: FR 2 824 400
Doc [6]: M. Giocondo, I. Lelidis, I. Dozov and G. Durand, Eur. Phys. J. AP 5, 227 (1999).
Doc [7]: I. Dozov and Ph. Martinot-Lagarde, Phys. Rev. E., 58, 7442 (1998).
Doc [8]: FR 2 824 400
Doc [9]: FR 2 847 704
Doc [10]: FR 03/02074

The invention claimed is:

1. A bistable nematic liquid-crystal matrix display device comprising:

two substrates having row electrodes placed on one of the two substrates, column electrodes placed on the other of the two substrates and nematic liquid crystal molecules placed between the two substrates, said row electrodes and column electrodes having respective perpendicular directions and defining at their intersection a matrix of pixels and said row and column electrodes receiving electrical control signals generating an electrical field perpendicular to the substrates which is applied to the nematic liquid crystal molecules and anchoring layers deposited on the row and column electrodes, said anchoring layers defining an anchoring alignment direction of the nematic liquid crystal molecules, wherein the application of a selection signal on a row while applying simultaneously column signals on the column electrodes determines the final state of each pixel of a selected row, and applying such selection signal in succession on each row allowing to select successively each row of the display, in which the transition into at least one of two bistable states is brought about by displacement of the liquid crystal in a displacement direction parallel to the anchoring alignment direction, characterized in that the anchoring alignment direction is not parallel to the direction of the row electrodes, so that addressing the various pixels of the display, by successive selection of the row electrodes does not switch simultaneously two pixels that are contiguous in the displacement direction.

2. The device as claimed in claim 1, characterized in that the anchoring alignment direction is inclined to the direction of the row electrodes.

3. The device as claimed in claim 1, characterized in that the anchoring alignment direction is perpendicular to the direction of the row electrodes.

4. The device as claimed in claim 1, characterized in that the anchoring alignment direction is inclined at about 45° to the direction of the row electrodes.

5. The device as claimed in claim 1, characterized in that the anchoring alignment direction is inclined at about 60° to the direction of the row electrodes.

6. The device as claimed in claim 1, characterized in that the anchoring alignment direction is obtained using one of the means chosen from the group comprising: a brushing operation; a polymer layer activated under polarized light; an oriented film deposited by vacuum evaporation; a grating.

7. The device as claimed in claim 1, characterized in that it includes means capable of applying control signals on the electrodes suitable for controlling the magnitude of the liquid-crystal displacement and progressively controlling the extent of one of the two stable states within each of the pixels, so as to generate controlled gray levels inside each of said pixels.

8. The device as claimed in one of claim 7, characterized in that said means are suitable for modulating at least one of the parameters of the control signals for controlling the gray levels generated.

9. The device as claimed in one of claim 7, characterized in that it includes means suitable for modulating at least one of the parameters of the column signals applied to the column electrodes.

10. The device as claimed in claim 7, characterized in that it includes means suitable for modulating the voltage level of the control signals.

11. The device as claimed in claim 7, characterized in that it includes means suitable for modulating the duration of the control signals.

12. The device as claimed in claim 7, characterized in that it includes means suitable for modulating the phase of the control signals.

13. The device as claimed in claim 7, characterized in that it includes means suitable for controlling the temperature of the device.

14. The device as claimed in claim 7, characterized in that it includes modulating means suitable for modulating the variables of the pixel control signals that govern the position of the boundary between two textures, so as to control a gray level.

15. The device as claimed in claim 14, characterized in that said modulating means are suitable for modulating voltage levels and respective durations.

16. The device as claimed claim 1, characterized in that it includes means suitable for modulating duration of all interval separating the row control signals between 10 μs and 20 ms.

17. The device as claimed in claim 1, characterized in that it includes addressing means suitable for defining an entire image in a single frame.

18. The device as claimed in claim 17, characterized in that the addressing means are suitable for modulating the column signals.

19. The device as claimed in claim 18, characterized in that the addressing means are suitable for modulating at least one of the following: the amplitude, the duration or the phase of the column signals.

20. The device as claimed claim 1, characterized in that it includes addressing means for defining an entire image in a single frame and for modulating the amplitude of the column signals.

21. The device as claimed in claim 1, characterized in that it includes addressing means suitable for defining an entire image in a single frame and for modulating the duration of the column signals.

22. The device as claimed in claim 1, characterized in that it includes addressing means suitable for defining an entire image in a single frame and for modulating the phase of the column signals.

23. The device as claimed in claim 1, characterized in that it includes addressing means suitable for defining an entire image with the aid of several successive frames.

24. The device as claimed in claim 23, characterized in that the addressing means are suitable for carrying out modulations of variables per frame.

25. The device as claimed in claim 24, characterized in that the addressing means are suitable for carrying out modulations of the parameters of row signals.

26. The device as claimed in claim 1, characterized in that the addressing means are suitable for controlling the state of the pixels by applying successive two-step control signals.

27. The device as claimed in claim 26, characterized in that the addressing means are suitable for applying signals specific to placing all of the pixels in a difficult or slow state in a first step.

28. The device as claimed in claim 26, characterized in that the addressing means are suitable for applying signals specific to placing all of the pixels in a difficult or slow state in a first step, then for applying signals specific to placing at least some of the pixels in an easy or rapid state, or to obtain a desired gray level, in a second step.

29. The device as claimed in claim 27, characterized in that the addressing means are suitable for applying control signals simultaneously to all of the pixels during the first step.

30. The device as claimed in claim 27, characterized in that the addressing means are suitable for applying control signals simultaneously to certain subassemblies or packets of row electrodes during the first step.

31. The device as claimed in claim 27, characterized in that the addressing means are suitable for applying control signals simultaneously to all of the pixels during the first step.

32. The device as claimed in claim 28, characterized in that the addressing means are suitable for applying row multiplexing signals of the one-stage or two-stage or multistage type during the second step.

33. The device as claimed in claim 28, characterized in that the addressing means are suitable for modulating at least one of the following: the amplitude, the duration or the phase of the column signals during the second step.

34. The device as claimed in claim 1, characterized in that it is of the BiNem type.

35. The device as claimed in claim 1, characterized in that it uses two textures, the twist of which differs by about ±180°.

36. The device as claimed in claim 1, characterized in that it uses two textures, one being uniform or slightly twisted, in which the licjuid crystal molecules are at least approximately mutually parallel, and the other differing from the first by a twist of about ±180°.

37. The device as claimed in claim 1, characterized in that it includes means designed to apply, to the column electrodes of the display, an electrical signal whose parameters are adapted in order to reduce the root mean square voltage of the parasitic pixel pulses to a value below the Freederiksz voltage, so as to reduce the parasitic optical effects of the addressing.

38. The device as claimed in claim 1, characterized in that it includes means capable of applying controlled electrical signals to row electrodes and to column electrodes of the display, respectively, comprising means suitable for simultaneously addressing several rows, by means of similar row signals temporally shifted by a delay equal to or longer than the column voltage application time, said row addressing signals having, in a first period, at least one voltage value for breaking the anchoring of all the pixels of the row and then, in a second period, for determining the final state of the pixels that make up the addressed row, this final state depending on the value of each of the electrical signals applied to the corresponding columns.

39. The device as claimed claim l, characterized in that addressing means capable of generating, and of applying to each of the pixels of the matrix display, control signals that have sloping rising edges, preferably sloping rising edges having a slope from 0.1 V/μs to 0.005 V/μs.

40. A method of display using a bistable nematic liquid-crystal matrix device comprising:

two substrates having row electrodes placed on one of the two substrates, column electrodes placed on the other of the two substrates and nematic liquid crystal molecules placed between the two substrates, said row electrodes and column electrodes having respective perpendicular directions and defining at their intersection a matrix of pixels, said row and column electrodes receiving electrical control signals generating an electrical field perpendicular to the substrates which is applied to the nematic liquid crystal molecules and anchoring layers deposited on the row and column electrodes, said anchoring layers defining an anchoring alignment direction of the nematic liquid crystal molecules, wherein the application of a selection signal on a row while applying simultaneously column signals on the column electrodes determines the final state of each pixel of a selected row, and applying such selection signal in succession on each row allowing to select successively each row of the display, in which the transition to at least one of the two bistable states is brought about by displacement of the liquid crystal in a displacement direction parallel to the anchoring alignment direction, characterized in that the anchoring alignment direction is not parallel to the direction of the row electrodes, so that step of addressing the various pixels of the display using electrical signals on the row electrodes does not switch simultaneously two pixels that are contiguous in the displacement direction.

* * * * *

UNITED STATES PATENT AND TRADEMARK OFFICE

CERTIFICATE OF CORRECTION

PATENT NO. : 7,616,180 B2
APPLICATION NO. : 10/557721
DATED : November 10, 2009
INVENTOR(S) : Philippe Martinot-Lagarde et al.

It is certified that error appears in the above-identified patent and that said Letters Patent is hereby corrected as shown below:

In the Specification, in the Detailed Description of the Invention, in Column 17, line 50, please delete “levels”, and insert -- by curtain effect according to the invention. --.

In the Claims, Column 29, Claim 36, line 41, please delete “licjuid” and insert -- liquid --.

Signed and Sealed this
Eighteenth Day of December, 2012

David J. Kappos

David J. Kappos
*Director of the United States Patent and Trademark Office*